US010752459B2

(12) United States Patent
Takada et al.

(10) Patent No.: US 10,752,459 B2
(45) Date of Patent: Aug. 25, 2020

(54) MEDIUM PROCESSING DEVICE AND MEDIUM TRANSACTION DEVICE

(71) Applicant: Oki Electric Industry Co., Ltd., Tokyo (JP)

(72) Inventors: Masaki Takada, Tokyo (JP); Atsushi Takada, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 155 days.

(21) Appl. No.: 15/570,053

(22) PCT Filed: Apr. 19, 2016

(86) PCT No.: PCT/JP2016/062439
§ 371 (c)(1),
(2) Date: Oct. 27, 2017

(87) PCT Pub. No.: WO2016/185859
PCT Pub. Date: Nov. 24, 2016

(65) Prior Publication Data

US 2018/0111779 A1 Apr. 26, 2018

(30) Foreign Application Priority Data

May 19, 2015 (JP) ..... 2015-102109

(51) Int. Cl.
*G07D 11/00* (2019.01)
*B65H 29/00* (2006.01)
(Continued)

(52) U.S. Cl.
CPC ..... *B65H 29/003* (2013.01); *B65H 5/28* (2013.01); *B65H 5/36* (2013.01); *B65H 29/006* (2013.01);
(Continued)

(58) Field of Classification Search
CPC ..... G07D 11/12; G07D 11/16; G07D 11/14; G07D 11/00; G07D 11/0003;
(Continued)

(56) References Cited

U.S. PATENT DOCUMENTS 9,016,611 B2 4/2015 Tosaka et al.
9,092,926 B2 7/2015 Iwatsuki et al.
(Continued)

FOREIGN PATENT DOCUMENTS

JP 2008-123093 A 5/2008
JP 2009-146240 A 7/2009
(Continued)

*Primary Examiner* — Thomas A Morrison
(74) *Attorney, Agent, or Firm* — Rabin & Berdo, P.C.

(57) ABSTRACT

An upper-side conveyance guide of a temporary holding section is provided with an upper-side movable guide that capable of moving in coordination with the drum diameter of a drum so as to be interposed between the upper-side conveyance guide and the drum at all times. The upper-side movable guide guides a banknote that is being conveyed gripped only at the center by a banknote conveying portion of a main tape, between the upper-side conveyance guide and the drum. Folding of the banknote is accordingly suppressed by the upper-side movable guide, enabling the banknote to be guided to a gap between the upper-side conveyance guide and a lower-side conveyance guide without catching on a rear face of the upper-side conveyance guide or the like. Accordingly, the banknote can be prevented from contacting portions that should not be contacted and causing conveyance issues as a result.

11 Claims, 14 Drawing Sheets

(51) Int. Cl.

| | |
|---|---|
| ***B65H 5/28*** | (2006.01) |
| ***B65H 5/36*** | (2006.01) |
| ***G07D 11/14*** | (2019.01) |
| ***G07D 11/16*** | (2019.01) |
| ***G07D 11/12*** | (2019.01) |
| ***B65H 29/52*** | (2006.01) |
| ***B65H 29/51*** | (2006.01) |

(52) U.S. Cl.
CPC ..... *B65H 29/51* (2013.01); *B65H 29/52* (2013.01); *G07D 11/12* (2019.01); *G07D 11/14* (2019.01); *G07D 11/16* (2019.01); *B65H 2301/415* (2013.01); *B65H 2301/419* (2013.01); *B65H 2301/41924* (2013.01); *B65H 2301/419225* (2013.01); *B65H 2701/1912* (2013.01)

(58) Field of Classification Search
CPC ..... G07D 11/0006; G07D 11/0018; G07D 11/0021; G07D 11/0024; G07D 11/0027; G07D 11/0033; G07D 11/0036; G07D 11/0045; G07D 2211/00; B65H 29/003; B65H 5/28; B65H 5/36; B65H 26/08; B65H 26/063; B65H 26/066; B65H 29/006; B65H 29/008; B65H 29/12; B65H 2301/4191; B65H 2701/1912; B65H 2401/221; B65H 2401/222; B65H 2511/142; B65H 2515/60; B65H 2553/612; B65H 43/08
See application file for complete search history.

(56) References Cited

U.S. PATENT DOCUMENTS

| | | | | |
|---|---|---|---|---|
| 9,546,066 | B2 * | 1/2017 | Iwasaki ..... | B65H 29/006 |
| 9,595,153 | B2 * | 3/2017 | Togiya ..... | B65H 29/006 |
| 2014/0131164 | A1 * | 5/2014 | Togiya ..... | B65H 29/006 194/206 |
| 2015/0298928 | A1 | 10/2015 | Iwasaki | |
| 2017/0323509 | A1 * | 11/2017 | Takada ..... | B65H 29/006 |

FOREIGN PATENT DOCUMENTS

| | | | |
|---|---|---|---|
| JP | 2010-6494 | A | 1/2010 |
| JP | 2013-25706 | A | 2/2013 |
| JP | 2013-61782 | A | 4/2013 |
| JP | 2013-199336 | A | 10/2013 |

* cited by examiner

MEDIUM PROCESSING DEVICE AND MEDIUM TRANSACTION DEVICE

TECHNICAL FIELD

The present invention relates to a medium processing device and a medium transaction device, and is preferably applied to an Automated Teller Machine (ATM) that is, for example, inserted with a medium such as banknotes by a customer and performs desired transactions.

BACKGROUND ART

Automated teller machines and the like that, according to contents of a transaction with a customer, accept pay-in of cash in the form of banknotes, coins, etc. from the customer, or pay out cash to the customer, are widely employed in financial institutions and the like.

An example of technology proposed for such an automated teller machine includes, for example, a banknote pay-in/pay-out port that accepts and dispenses banknotes for a customer, a classification section that classifies the denomination and authenticity of inserted banknotes, a temporary holding section that temporarily holds inserted banknotes, and banknote cassettes that store banknotes by denomination.

Temporary holding sections include configurations including, for example, a circular cylinder shaped drum that rotates, a tape having one end fixed to a circumferential side face of the drum, a reel around which the tape is wound, and plural rollers that move the tape along a desired travel path. Such temporary holding sections store banknotes by wrapping the banknotes onto the circumferential side face of the drum together with the tape, and peeling off and feeding out the banknotes from the circumferential side face together with the tape (see, for example, Japanese Patent Application Laid-Open (JP-A) No. 2009-146240 (Patent Document 1)).

Conventional temporary holding sections include configurations in which, for example, the length direction center of a banknote is pressed against and wrapped onto the circumferential side face of a drum using a single tape, and configurations in which the length direction center and the vicinities of both ends of a banknote are pressed against and wrapped onto the circumferential side face of a drum using three tapes.

Note that FIG. 13 illustrates a temporary holding section 200 of a type in which a banknote is pressed against a drum by a single tape. In this temporary holding section 200, a tape 202 pulled out from a reel 201 travels to the front of a roller 203, before doubling back toward the rear around a first tape roller 204 and proceeding toward a circumferential side face 205S of a drum 205. After completing approximately three quarters of a revolution around the circumferential side face 205S in the vicinity of the axial direction center of the circumferential side face 205S, the tape 202 is initially pulled away from the circumferential side face 205S, before doubling back around a second tape roller 206 disposed at the upper side of the first tape roller 204 and travelling so as to return toward the circumferential side face 205S, and then being wrapped around the vicinity of the axial direction center of the circumferential side face 205S.

In this temporary holding section 200, the portion of the tape 202 doubled back around the first tape roller 204 and the portion of the tape 202 doubled back around the second tape roller 206 overlap each other from above and below, and the center of a banknote (not illustrated in the drawings) is gripped and conveyed by this overlapping portion (referred to as the banknote conveying portion). The banknote is then wrapped onto the drum 205 together with the tape 202 and stored. The banknote wrapped onto the drum 205 together with the tape 202 is peeled away and fed out from the drum 205 together with the tape 202.

Moreover, FIG. 14 illustrates a temporary holding section 210 of a type in which a banknote is pressed against a drum by three tapes. In this temporary holding section 210, in addition to a configuration substantially the same as that of the temporary holding section 200, two tapes (referred to as auxiliary tapes) 212 that are pulled out from auxiliary reels 211 coaxial to the reel 201 are caused to travel toward front by respective rollers 213, then double back toward the rear around rollers 214 and proceed toward a circumferential side face 205S of a drum 205, and are wrapped onto the circumferential side face 205S in the vicinity of both axial direction ends of the circumferential side face 205S.

In this temporary holding section 210 too, the center of a banknote is conveyed gripped by a banknote conveying portion of the central tape (referred to as the main tape) 202. The banknote is then wrapped onto the drum 205 together with the main tape 202, and the vicinity of both ends of the banknote are stored pressed against the drum 205 by the two auxiliary tapes 212. Moreover, the banknote wrapped onto the drum 205 together with the three tapes 202, 212 are peeled off and fed out from the drum 205 together with the three tapes 202, 212.

SUMMARY OF INVENTION

Technical Problem

However, in conventional temporary holding sections, both in types in which banknotes are pressed against the drum by a single tape and in types in which banknotes are pressed against the drum by three tapes, as illustrated in FIG. 15, for example, immediately after a banknote is peeled away from the circumferential side face 205S of the drum 205 (or immediately before being taken up onto the circumferential side face 205S of the drum), a banknote BL is in a state gripped only at the center by the tape 202. Accordingly, in cases in which, for example, the two ends of the banknote BL are creased such that they lift away, the two ends of the banknote will lift away. As a result, as illustrated in FIG. 16, sometimes a portion of the banknote BL that has lifted away will contact a portion inside the temporary holding section that should not be contacted by the banknote BL, causing conveyance issues.

In consideration of the above circumstances, the present invention proposes a medium processing device and a medium transaction device capable of obtaining a marked reduction in conveyance issues in comparison to hitherto.

Solution to Problem

In order to address such issues, the present invention includes a drum, a main tape, a main reel, a first tape roller, a second tape roller, a medium conveyance guide, and a movable guide. The drum that is rotatably supported, and wraps a paper sheet shaped medium onto a circumferential side face of the drum. The main tape has one end fixed to the circumferential side face of the drum, and wraps the medium onto the circumferential side face of the drum accompanying rotation of the drum such that the medium is interposed between the circumferential side face and the main tape. The main reel takes up the main tape. The first tape roller is provided at a position separated from the circumferential side face of the drum and around which the main tape pulled out from the main reel doubles back toward the circumferential side face of the drum. The second tape roller is provided at a position separated from the circumferential side face of the drum, and the main tape having been briefly pulled away from the circumferential side face doubles back around the second tape roller so as to return toward the circumferential side face, after the main tape has been doubled back around the first tape roller and travelled along the circumferential side face of the drum. The medium conveyance guide is fixed at a position separated from the circumferential side face of the drum, supports the second tape roller, and guides conveyance of the medium. The movable guide is provided to the medium conveyance guide so as to be capable of moving to follow a drum diameter of the drum as the drum diameter changes according to a wrap-on amount of the medium. The movable guide also guides a medium being conveyed gripped between a portion of the main tape doubled back around the first tape roller and a portion of the main tape doubled back around the second tape roller such that the medium is guided between the circumferential side face of the drum and the medium conveyance guide.

Accordingly, the medium is conveyed in a state gripped by the main tape immediately after being peeled away from the circumferential side face of the drum (or immediately before being taken up onto the circumferential side face of the drum), and can be guided by the movable guide that is interposed between the drum and the medium conveyance guide at all times. This thereby enables folding of the medium by the movable guide to be suppressed even when, for example, the medium is creased. This thereby enables the medium to be prevented from contacting portions that should not be contacted and causing conveyance issues as a result.

Advantageous Effects of Invention

The present invention is capable of achieving a medium processing device and a medium transaction device capable of obtaining a marked reduction in conveyance issues in comparison to hitherto.

DESCRIPTION OF EMBODIMENTS

Explanation follows regarding embodiments for implementing the present invention (referred to below as exemplary embodiments), with reference to the drawings.

1. First Exemplary Embodiment

1-1. Overall Configuration of ATM

Figure 1:
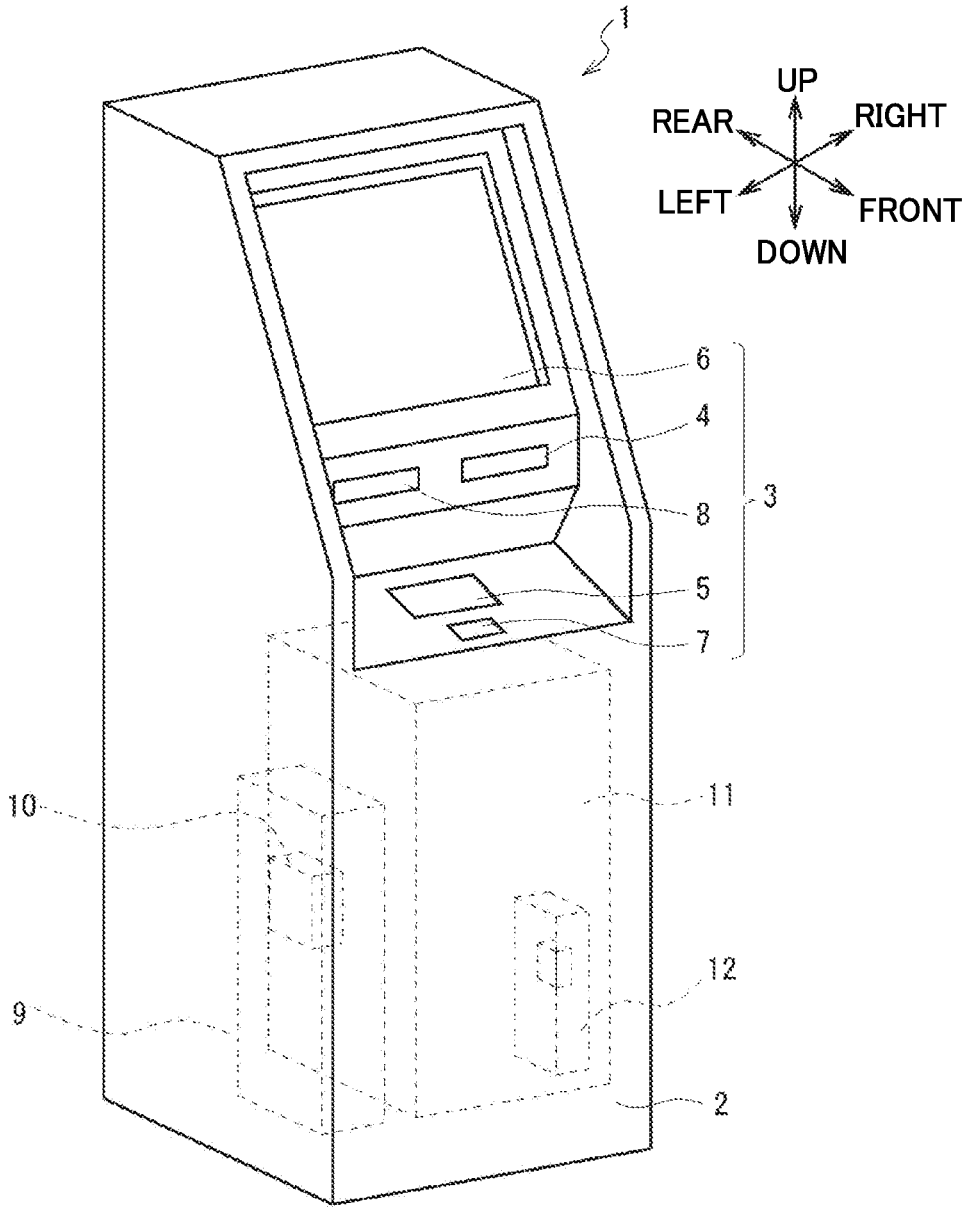
FIG. 1 is a perspective view illustrating an external configuration of an ATM.

As illustrated in the external view of FIG. 1, an ATM 1 is configured around a box shaped casing 2, and is, for example, installed in a financial institution or the like, to perform cash transactions such as pay-in transactions and pay-out transactions with a customer. In the following explanation, the front side is defined as the side of the ATM 1 that a customer faces, and the opposite side thereto is defined as the rear side. The upper side, lower side, left side, and right side are respectively defined corresponding to up, down, left, and right from the perspective of a customer facing the front side.

The ATM 1 is provided with a customer interface 3 at an upper portion of a front face of the casing 2. The customer interface 3 is configured by a card insertion/removal port 4, a pay-in/pay-out port 5, an operation and display section 6, a ten-key 7, and a receipt issue port 8. The customer interface 3 is a section that directly handles, for example, cash and passbook transactions with the customer, notifies transaction-related information, and receives operation instructions.

The card insertion/removal port 4 is a section through which various cards, such as cash cards, are inserted and returned. A card processor (not illustrated in the drawings) that reads, for example, account numbers magnetically recorded on the various cards is provided at the back of the card insertion/removal port 4.

The pay-in/pay-out port 5 is a section into which banknotes for paying in are inserted by a customer, and from which banknotes for paying out to a customer are dispensed. The pay-in/pay-out port 5 is opened up or closed off by driving a shutter. The operation and display section 6 includes an integral liquid-crystal display (LCD) that displays operation screens during transactions, and a touch panel that is input with, for example, a transaction type selection, a PIN, or a transaction amount.

The ten-key 7 is employed during operation to input PINs, a transaction amounts, and the like. The receipt issue port 8 is a section that issues a receipt printed with transaction details and the like at the end of transaction processing. A receipt processor (not illustrated in the drawings) that prints transaction details and the like on a receipt is provided at the back of the receipt issue port 8.

A main controller 9 that performs general control of the overall ATM 1, a storage section 10 that stores transaction information and the like, and a banknote pay-in/pay-out unit 11 that performs various processing relating to banknote pay-in and pay-out, are provided inside the ATM 1. The main controller 9 is configured around a central processing unit (CPU), not illustrated in the drawings. The storage section 10 is configured by a hard disk drive, flash memory, or the like.

The banknote pay-in/pay-out unit 11 includes a unit controller 12. The unit controller 12 is configured around a CPU, not illustrated in the drawings, and reads and executes predetermined programs from the storage section 10 via the main controller 9 in order to control various sections of the banknote pay-in/pay-out unit 11 so as to perform various processing such as pay-in transactions and pay-out transactions.

Figure 2:
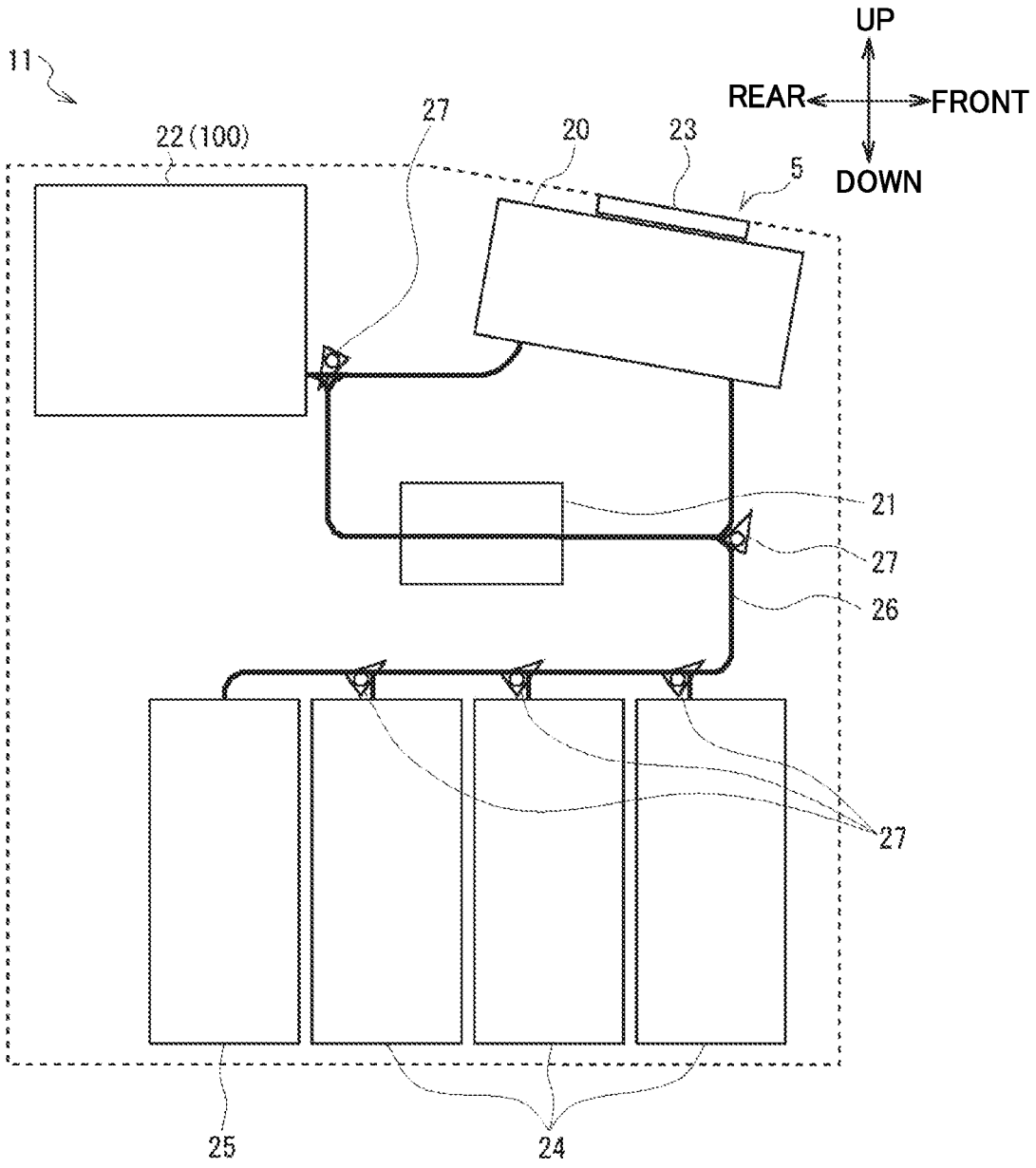
FIG. 2 is a side view illustrating an internal configuration of a banknote pay-in/pay-out unit.

As illustrated in FIG. 2, a banknote pay-in/pay-out section 20 including the pay-in/pay-out port 5, a classification section 21 that classifies banknotes by denomination and authenticity, and a temporary holding section 22 that temporarily stores paid-in banknotes and the like, are provided inside an upper portion of the banknote pay-in/pay-out unit 11. The pay-in/pay-out port 5 of the banknote pay-in/pay-out section 20 is provided with a shutter 23, and the pay-in/pay-out port 5 is opened up and closed off by opening and closing the shutter 23.

Recycling boxes 24 in which banknotes are stacked by denomination, and a pay-in box 25 that stores banknotes (such as damaged banknotes) that have been determined to be abnormal as a result of classification by the classification section 21, are provided inside a lower portion of the banknote pay-in/pay-out unit 11.

Moreover, the banknote pay-in/pay-out section 20, the classification section 21, the temporary holding section 22, the recycling boxes 24, and the pay-in box 25 are connected together by a conveyance section 26. The conveyance section 26 uses rollers, belts, and the like, not illustrated in the drawings, to convey rectangular banknotes along conveyance paths, illustrated by bold lines in the drawings, along a direction aligned with the short edges of the banknotes. Moreover, selectors 27 are provided at junctions in the conveyance section 26. The selectors 27 swing under the control of the unit controller 12 so as to switch the conveyance destinations of banknotes.

The classification section 21 classifies banknotes passing through the interior of the classification section 21 by denomination, authenticity, degree of damage (physical condition), and the like, and notifies the unit controller 12 of the classification results thereof. During pay-in, the temporary holding section 22 temporarily stores banknotes inserted into the pay-in/pay-out port 5 by a customer, and temporarily holds pay-in acceptable banknotes classified as being acceptable for pay-in by the classification section 21 until the pay-in is confirmed. On the other hand, pay-in unacceptable banknotes classified as being unacceptable for pay-in by the classification section 21 are discharged into the banknote pay-in/pay-out section 20 in what may be described as a "last in, first out" sequence. Moreover, during pay-out, the temporary holding section 22 temporarily holds pay-out unacceptable banknotes classified as being unacceptable for pay-out by the classification section 21 until pay-out acceptable banknotes have been paid out, and then discharges the pay-out unacceptable banknotes into the pay-in box 25.

The recycling boxes 24 are, for example, provided for each denomination, and use a storage/discharge mechanism to take in and store banknotes conveyed by the conveyance section 26, and to discharge and feed stored banknotes to the conveyance section 26.

In the ATM 1 configured as described above, the main controller 9 and the unit controller 12 control the respective sections based on, for example, the banknote classification results of the classification section 21 so as to perform banknote pay-in processing and pay-out processing.

Namely, in a pay-in transaction, when a customer selects a pay-in transaction using the operation and display section 6, the ATM 1 opens the shutter 23, and when banknotes have been inserted into the pay-in/pay-out port 5, the ATM 1 closes the shutter 23 and conveys the inserted banknotes one note at a time from the banknote pay-in/pay-out section 20 to the classification section 21. The ATM 1 conveys banknotes determined to be pay-in acceptable banknotes based on the classification results of the classification section 21 to the temporary holding section 22 to be temporarily stored, and returns banknotes determined to be pay-in unacceptable banknotes that are unsuitable for pay-in to the banknote pay-in/pay-out section 20, and opens the shutter 23 to return the banknotes to the customer.

Then, when the pay-in amount has been confirmed by the customer, the ATM 1 conveys the banknotes stored in the temporary holding section 22 to the classification section 21 and obtains classification results.

The ATM 1 conveys banknotes determined to be storable banknotes based on the classification results of the classification section 21 to the recycling box 24 of the corresponding denomination for safekeeping. On the other hand, the ATM 1 conveys banknotes determined to be non-storable banknotes that are unsuitable for storage to the pay-in box 25 for safekeeping separately from the storable banknotes.

Moreover, in a pay-out transaction, when a customer selects a pay-out transaction and inputs a pay-out amount using the operation and display section 6, the ATM 1 identifies the number of banknotes of each denomination required to make up the requested amount, feeds out banknotes from the respective recycling boxes 24 according to the number of banknotes of each denomination, and conveys the banknotes to the classification section 21 to obtain classification results.

The ATM 1 conveys banknotes determined to be pay-out acceptable banknotes based on the classification results of the classification section 21 to the banknote pay-in/pay-out section 20. On the other hand, the ATM 1 conveys banknotes determined to be pay-out unacceptable banknotes that are unsuitable for pay-out to the temporary holding section 22 to be temporarily stored.

When the banknotes making up the requested amount have been stacked in the banknote pay-in/pay-out section 20, the ATM 1 opens the shutter 23. This places the banknotes stacked in the banknote pay-in/pay-out section 20 in a collectable state, and the customer collects the banknotes. The ATM 1 then conveys any pay-out unacceptable banknotes stored in the temporary holding section 22 to the pay-in box 25 for safekeeping.

The ATM 1 performs banknote pay-in transactions and pay-out transactions in the above manner.

1-2. Temporary Holding Section Configuration

Figure 3A:
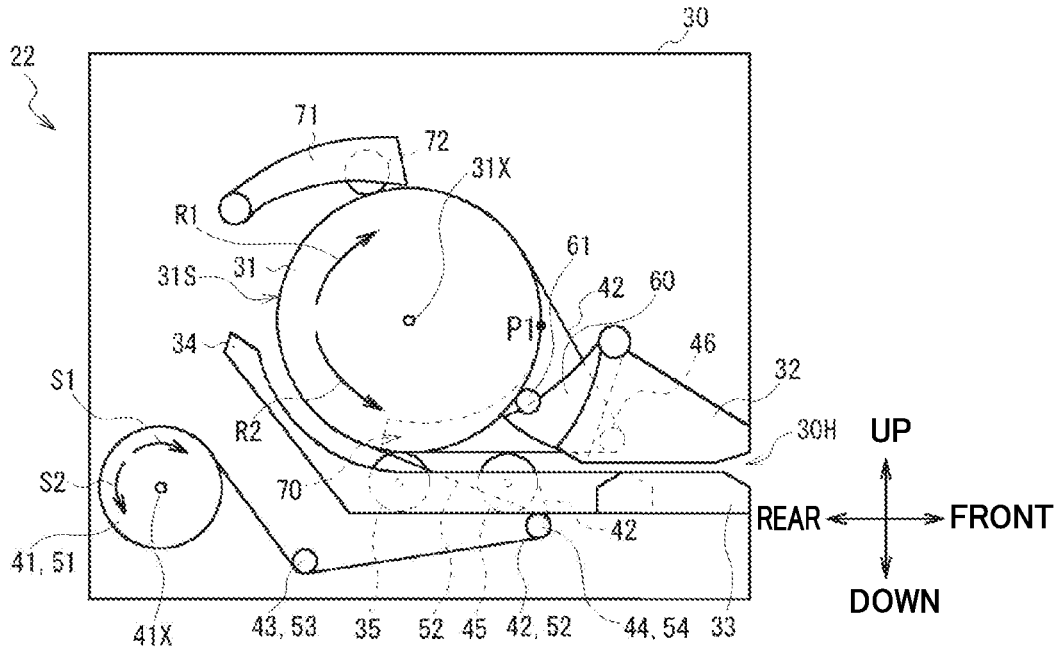
FIG. 3A is a side view illustrating an internal configuration of a temporary holding section of a first exemplary embodiment.
Figure 3B:
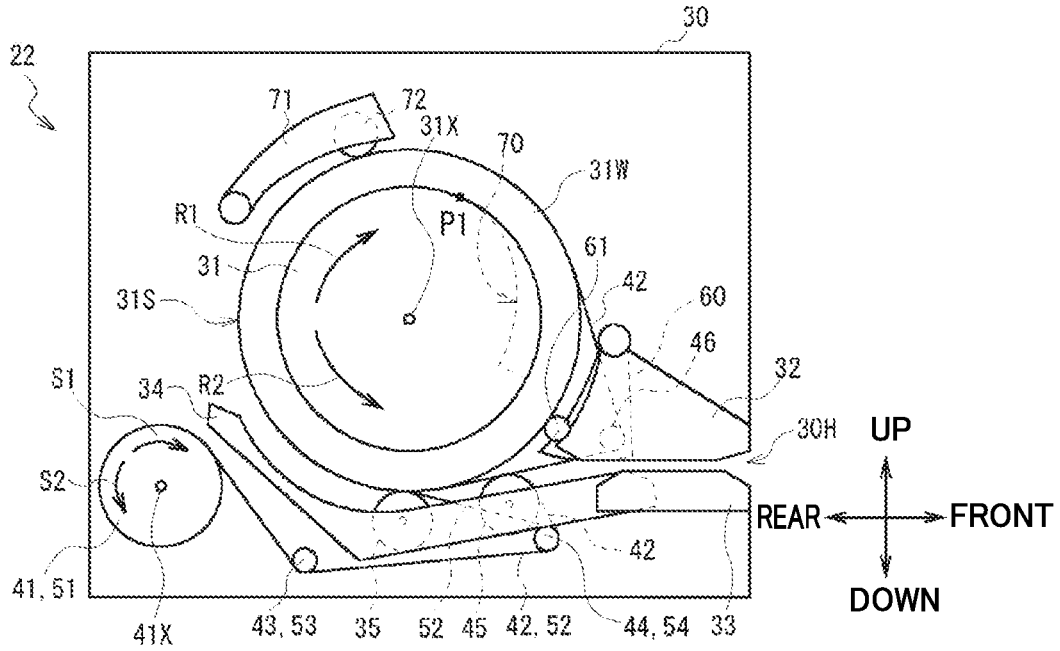
FIG. 3B is a side view illustrating an internal configuration of a temporary holding section of the first exemplary embodiment.
Figure 4:
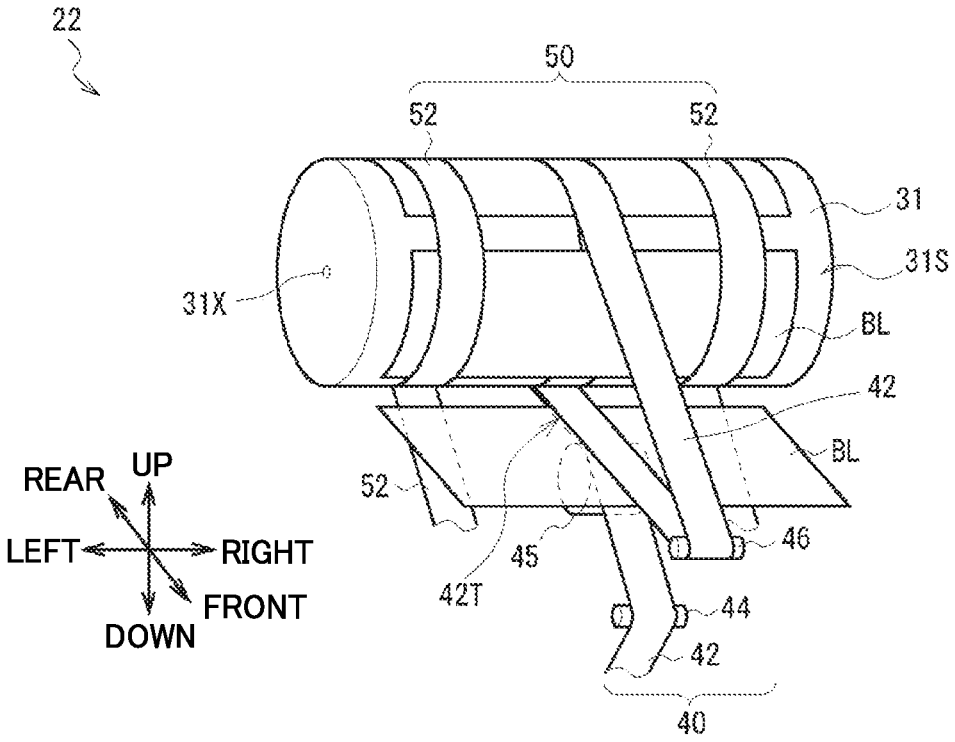
FIG. 4 is a perspective view illustrating an external configuration of a temporary holding section of the first exemplary embodiment.

Next, explanation follows regarding configuration of the temporary holding section 22, with reference to FIG. 3 and FIG. 4. As illustrated in FIG. 3A and FIG. 3B, the outside of the temporary holding section 22 is covered by a frame 30, inside which each component is attached. Note that FIG. 3A and FIG. 3B are schematic side views illustrating the temporary holding section 22 from the left, and for ease of explanation, some components are shown as if transparent, are omitted, or have been simplified.

A circular cylinder shaped drum 31 that rotates about a rotation shaft 31X extending along a left-right direction is provided in the vicinity of the center inside the frame 30. Drive force is transmitted to the drum 31 from a motor or the like, not illustrated in the drawings, such that the drum 31 rotates in a take-up direction R1 or an unwind direction R2.

As will be described in detail later, when banknotes are wrapped onto a circumferential side face 31S of the drum 31, a wrapped layer 31W is formed at the outer periphery of the drum 31, as illustrated in FIG. 3B. When this occurs, the apparent diameter of the drum 31, configured by the diameter of the drum 31 plus the thickness of the wrapped layer 31W, increases in size in comparison to in a state in which no banknotes are wrapped thereon (FIG. 3A). Note that in the following explanation, the apparent diameter is referred to as the "drum diameter". Moreover, when banknotes have been wrapped onto the drum 31, an outermost periphery of the wrapped layer 31W configures the circumferential side face 31S. Namely, when banknotes are wrapped onto the drum 31, the drum diameter increases in size and the circumferential side face 31S becomes further from the rotation shaft 31X of the drum 31.

An insertion hole 30H to allow banknote insertion is provided through a front face of the frame 30. An upper-side conveyance guide 32 and a lower-side conveyance guide 33 that respectively guide banknotes from above and below are provided at the rear of the insertion hole 30H.

A lower face of the upper-side conveyance guide 32 is a substantially flat and substantially horizontal guide face, and is fixed to the frame 30. An upper face of the lower-side conveyance guide 33 is a substantially flat and substantially horizontal guide face, and is fixed to the frame 30 such that a gap of, for example, approximately 5 mm is formed between the upper face of the lower-side conveyance guide 33 and the lower face of the upper-side conveyance guide 32.

Namely, the temporary holding section 22 is capable of guiding banknotes in a front-rear direction through the gap between the upper-side conveyance guide 32 and the lower-side conveyance guide 33. Note that the upper-side conveyance guide 32 and the lower-side conveyance guide 33 are, for example, formed from a transparent resin material.

Moreover, a lower-side movable guide 34 is provided at a rear side of the lower-side conveyance guide 33, such that the lower-side movable guide 34 is positioned at a lower side of the drum 31. An upper face of a front-half portion of the lower-side movable guide 34 configures a flat guide face that extends the upper face of the lower-side conveyance guide 33. Moreover, an upper face of a rear-half portion of the lower-side movable guide 34 configures a curved guide face following the circumferential side face 31S of the drum 31. Note that, for example, the lower-side movable guide 34 is also formed from a transparent resin material.

A drum-abutting roller 35 is provided to the rear-half portion of the lower-side movable guide 34, at a position substantially directly under the drum 31. The drum-abutting roller 35 is configured in a circular column shape extending along the left-right direction, and is rotatably supported by the lower-side movable guide 34. An upper-side portion of the drum-abutting roller 35 projects further upward than the upper face of the lower-side movable guide 34 so as to abut the circumferential side face 31S of the drum 31.

A front end portion of the lower-side movable guide 34 is swingably supported by a rear end portion of the lower-side conveyance guide 33, and is biased in a direction so as to be pressed against the circumferential side face 31S of the drum 31 by a torsion spring or the like. The lower-side movable guide 34 is thus capable of moving so as to follow changes in the drum diameter of the drum 31, and causes the drum-abutting roller 35 to abut the circumferential side face 31S of the drum 31 at all times.

A spindle shaped main reel 41 that rotates about a rotation shaft 41X extending in the left-right direction is provided diagonally below and to the rear of the drum 31, at substantially the left-right direction center. A left-right direction length of the main reel 41 is formed sufficiently shorter than that of the drum 31. Moreover, drive force is transmitted to the main reel 41 from a motor or the like, not illustrated in the drawings, such that the main reel 41 rotates in a pull-out direction S1 or a take-up direction S2.

A main tape 42 is taken up on the main reel 41. The main tape 42 is, for example, configured by a comparatively soft resin material, and is formed in a long, narrow, thin film shape. The width (left-right direction length) of the main tape 42 is slightly shorter than the width of the main reel 41, and is sufficiently shorter than the left-right direction length of the drum 31. One end of the main tape 42 is fixed to a circumferential side face of the main reel 41.

Moreover, a roller 43 is disposed in front of the main reel 41. A first tape roller 44 that is rotatably supported by the lower-side movable guide 34 is disposed in front of the roller 43, at a position further toward the front than the drum-abutting roller 35. The roller 43 and the first tape roller 44 are each configured in a circular column shape extending along the left-right direction and each has a left-right direction length that is sufficiently shorter than that of the drum 31. The roller 43 and the first tape roller 44 are each configured in a circular column shape extending along the left-right direction, and the left-right direction lengths thereof are formed sufficiently shorter than that of the drum 31.

Moreover, the lower-side movable guide 34 is provided with a feed roller 45 between the first tape roller 44 and the drum-abutting roller 35. The feed roller 45 is configured in a circular column shape extending along the left-right direction, and is rotatably supported by the lower-side movable guide 34. Similarly to the drum-abutting roller 35, an upper-side portion of the feed roller 45 projects out further upward than the upper face of the lower-side movable guide 34. Moreover, the feed roller 45 is also formed with a left-right direction length sufficiently shorter than that of the drum 31.

A hole (not illustrated in the drawings) through which the main tape 42 passes is provided in front of the feed roller 45. This hole penetrates through the lower-side movable guide 34 in the up-down direction and has a left-right direction length that is greater than the width of the main tape 42.

A second tape roller 46 is provided inside the upper-side conveyance guide 32. The second tape roller 46 is configured in a circular column shape extending along the left-right direction, and is rotatably supported by the upper-side conveyance guide 32. The left-right direction length of the second tape roller 46 is also formed sufficiently shorter than that of the drum 31.

The upper-side conveyance guide 32 is also provided with a hole (not illustrated in the drawings) through which the main tape 42 passes. This hole extends from a rear face of the upper-side conveyance guide 32 toward an upper side of the second tape roller 46, passes the front side of a circumferential side face of the second tape roller 46, and is in communication with the lower face of the upper-side conveyance guide 32. The left-right direction length of the hole is greater than the width of the main tape 42.

Note that the drum-abutting roller 35, the roller 43, the first tape roller 44, the feed roller 45, and the second tape roller 46 each have a left-right direction length that is slightly longer than the left-right direction length (namely, the tape width) of the main tape 42.

The main tape 42 taken up on the main reel 41 is pulled out from the main reel 41 toward the front, is then entrained around the roller 43 and the first tape roller 44 in sequence, and doubles back diagonally above and to the rear of the first tape roller 44. The main tape 42 is then entrained around the upper portion of the feed roller 45 and heads toward the rear, and enters between the drum-abutting roller 35 and the drum 31 so as to be pressed against the circumferential side face 31S of the drum 31 by the drum-abutting roller 35.

The main tape 42 then follows the circumferential side face 31S of the drum 31 around the rear-side half of the circumference of the drum 31, as far as the upper end of the drum 31. The main tape 42 is then pulled away from the circumferential side face 31S at a point approximately a further one eighth to one quarter around the circumferential side face 31S. The main tape 42 then heads toward the second tape roller 46 positioned diagonally below and to the front of the drum 31.

The main tape 42 is then entrained around the second tape roller 46 so as to double back toward the rear around the second tape roller 46. The main tape 42 is then entrained around the upper portion of the feed roller 45 and heads toward the rear so as to enter between the drum-abutting roller 35 and the drum 31, and is pressed against the circumferential side face 31S of the drum 31, before finally being taken up onto the drum 31. Note that a leading end of the main tape 42 is fixed to the left-right direction center of the circumferential side face 31S of the drum 31.

The portion of the main tape 42 doubled back around the first tape roller 44 and the portion of the main tape 42 doubled back around the second tape roller 46 overlap each other from above and below between the feed roller 45 and the circumferential side face 31S of the drum 31. Moreover, as will be described in detail later, as illustrated in FIG. 4, the main tape 42 grips banknotes BL and conveys the banknotes BL in the front-rear direction at the overlapping portion between the feed roller 45 and the circumferential side face 31S. Note that the overlapping portion between the feed roller 45 and the circumferential side face 31S is referred to as the banknote conveying portion 42T of the main tape 42.

The temporary holding section 22 rotates the drum 31 in the take-up direction R1 so as to move the main tape 42 along the path described above while pulling on the main tape 42 with the drum 31, thereby taking up the main tape 42 on the circumferential side face 31S of the drum 31. The temporary holding section 22 also rotates the main reel 41 in the take-up direction S2 and rotates the drum 31 in the unwind direction R2 such that the main tape 42 is peeled away from the circumferential side face 31S of the drum 31 and travels along the path described above in the reverse direction, thereby taking up the main tape 42 on the main reel 41. Tension accordingly acts on all locations of the main tape 42 along the path.

Note that for ease of explanation, the main reel 41, the main tape 42, the roller 43, the first tape roller 44, the feed roller 45, the drum-abutting roller 35, and the second tape roller 46 are referred to collectively as the main tape moving system 40 (see FIG. 4). Each component of the main tape moving system 40 is disposed substantially at the left-right direction center of the temporary holding section 22.

Moreover, at two locations on the left and right of the main reel 41, the temporary holding section 22 is provided with auxiliary reels 51 that rotate about the rotation shaft 41X, similarly to the main reel 41. The auxiliary reels 51 are spindle shaped, similarly to the main reel 41, and each has a left-right direction length formed sufficiently shorter than that of the drum 31. Similarly to the main reel 41, drive force is transmitted to the auxiliary reels 51 from a motor or the like, not illustrated in the drawings, thereby rotating the auxiliary reels 51 in the pull-out direction S1 or the take-up direction S2.

An auxiliary tape 52 is taken up on each auxiliary reel 51. Similarly to the main tape 42, the auxiliary tapes 52 are configured from a comparatively soft resin material, and are each formed in a long, narrow, thin film shape. The width of each auxiliary tape 52 is slightly shorter than the width of the auxiliary reels 51, and is sufficiently shorter than the left-right direction length of the drum 31. One end of each auxiliary tape 52 is fixed to a circumferential side face of the corresponding auxiliary reel 51.

Respective rollers 53 that are coaxial to the roller 43 are provided at two locations, on the left and right of the roller 43. Respective rollers 54 that are coaxial to the first tape roller 44 are likewise provided at two locations, on the left and right of the first tape roller 44.

The respective auxiliary tapes 52 taken up on the auxiliary reels 51 are pulled out from the corresponding auxiliary reel 51 toward the front, are then entrained around the rollers 53 and the rollers 54 in sequence, and double back diagonally above and to the rear of the rollers 54. The auxiliary tapes 52 then abut the circumferential side face 31S in the vicinity of a lower end of the circumferential side face 31S of the drum 31 and are taken up onto the drum 31 in this state.

Note that the two auxiliary tapes 52 each travel at a position separated from the main tape 42 in the left-right direction. Leading ends of the auxiliary tapes 52 are fixed to the vicinity of the two left-right direction ends of the circumferential side face 31S of the drum 31. Accordingly, the two auxiliary tapes 52 are taken up at positions separated in the left-right direction from the main tape 42 that is taken up at the left-right direction center of the circumferential side face 31S (in the vicinity of the two left-right direction ends of the circumferential side face 31S).

Note that for ease of explanation, the auxiliary reels 51, the auxiliary tapes 52, and the rollers 53 and 54 are referred to collectively as the auxiliary tape moving system 50 (see FIG. 4). The respective components of the auxiliary tape moving system 50 are disposed at positions that do not overlap in the left-right direction with the positions of the respective components of the main tape moving system 40.

In the temporary holding section 22, when storing banknotes BL, the drum 31 is rotated in the take-up direction R1 so as to move the main tape 42, and banknotes BL entering through the insertion hole 30H are conveyed toward the rear through the gap between the upper-side conveyance guide 32 and the lower-side conveyance guide 33, and are then conveyed toward the rear gripped at the center by the banknote conveying portion 42T of the main tape 42. Accompanying rotation of the drum 31, the temporary holding section 22 wraps the banknotes BL onto the circumferential side face 31S together with the main tape 42 gripping the banknotes BL, in a state still gripped by the main tape 42. The lower-side movable guide 34 is capable of moving so as to follow changes in the drum diameter, such that the drum-abutting roller 35 abuts the circumferential side face 31S at all times as this is performed.

Moreover, when this is performed, the auxiliary tapes 52 are wrapped onto the circumferential side face 31S in the vicinity of the lower end of the circumferential side face 31S of the drum 31, in a state in which banknotes BL are sandwiched between the auxiliary tapes 52 and the circumferential side face 31S. The temporary holding section 22 is thereby capable of pressing both a central portion and left and right end portions of each banknote BL against the circumferential side face 31S of the drum 31 using each of the main tape 42 and the two auxiliary tapes 52. This thereby enables the two end portions of banknotes BL to be prevented from lifting away from the circumferential side face 31S.

On the other hand, when feeding out banknotes BL, the temporary holding section 22 rotates the main reel 41 and the auxiliary reels 51 in the take-up direction S2, and rotates the drum 31 in the unwind direction R2, such that the main tape 42 and the auxiliary tapes 52 travel in the opposite direction to that during storage, such that the banknotes BL wrapped around the drum 31 are peeled away from the drum 31 together with the main tape 42.

The banknotes BL that have been peeled away from the drum 31 are gripped by the banknote conveying portion 42T of the main tape 42 and conveyed toward the front, conveyed toward the front through the gap between the upper-side conveyance guide 32 and the lower-side conveyance guide 33, and fed out through the insertion hole 30H.

Figure 5:
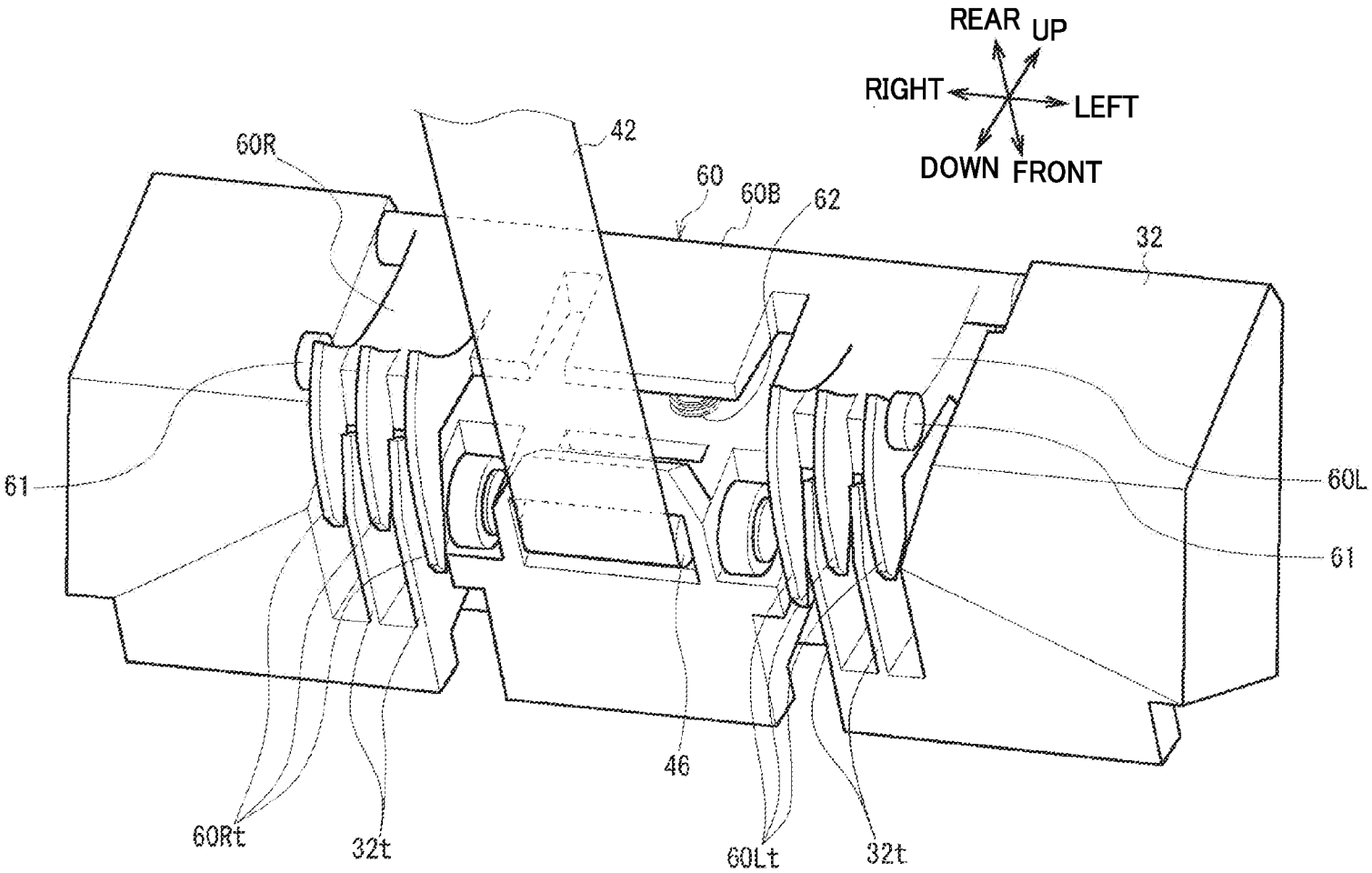
FIG. 5 is a perspective view illustrating an external configuration of an upper-side movable guide of the first exemplary embodiment.
Figure 6A:
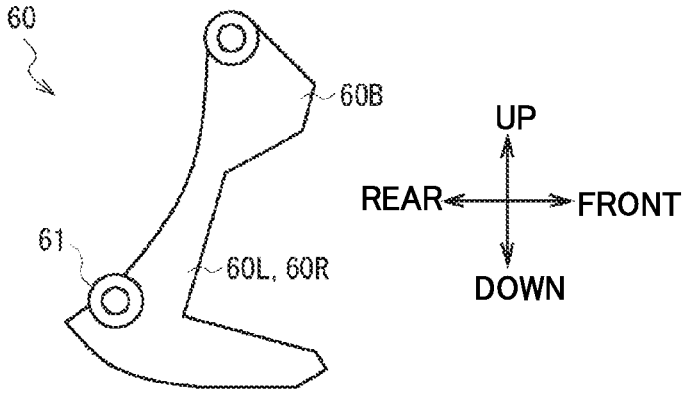
FIG. 6A is a diagram illustrating an external configuration of an upper-side movable guide of the first exemplary embodiment.
Figure 6B:
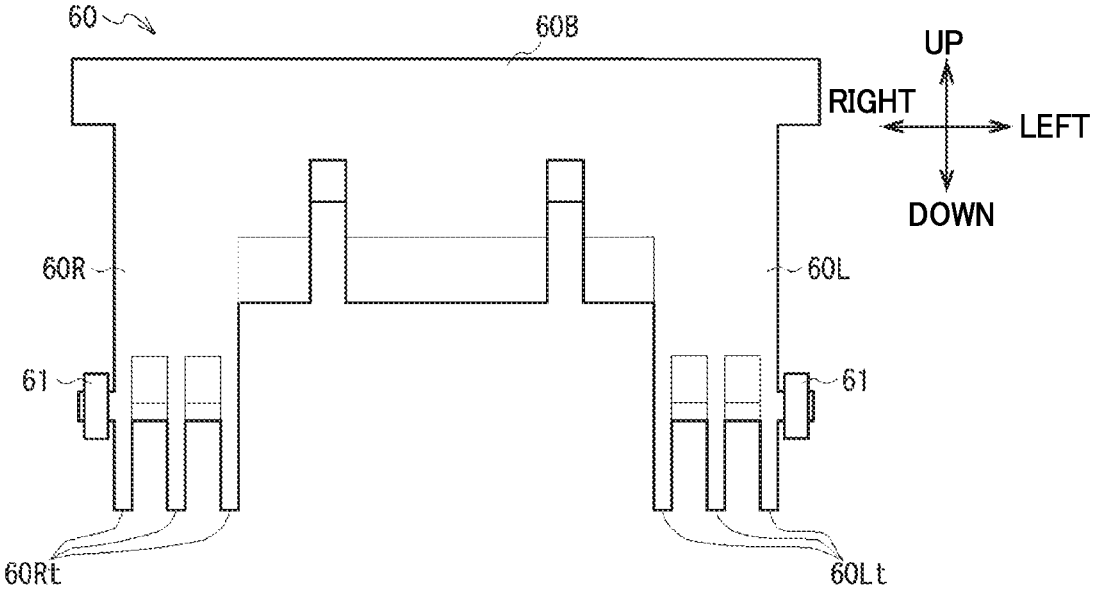
FIG. 6B is a diagram illustrating an external configuration of an upper-side movable guide of the first exemplary embodiment.
Figure 6C:
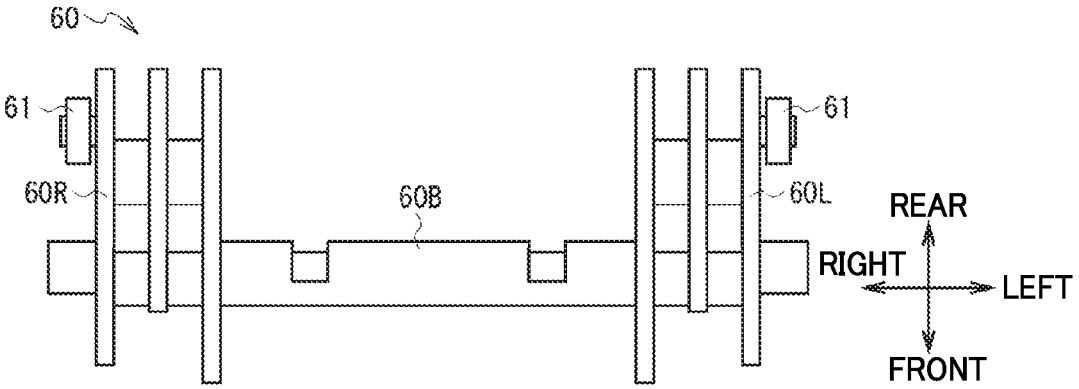
FIG. 6C is a diagram illustrating an external configuration of an upper-side movable guide of the first exemplary embodiment.

In addition to the configuration described above, the temporary holding section 22 is also provided with an upper-side movable guide 60 at the rear side of the upper-side conveyance guide 32. As illustrated in FIG. 5 and FIG. 6, the upper-side movable guide 60 is configured by a base 60B extending in the left-right direction, and legs 60L, 60R extending downward from both left and right end portions of the base 60B. As illustrated in FIG. 6B, as viewed from the rear side (or the front side), the upper-side movable guide 60 has a shape resembling three sides of a square opening at the lower side.

A rear face of the upper-side movable guide 60 (namely a face opposing the drum 31) is curved so as to follow the circumferential side face 31S of the drum 31. Moreover, following rollers 61 are rotatably supported in the vicinity of lower ends of respective outer faces of the two legs 60L, 60R of the upper-side movable guide 60. Rear side portions of the following rollers 61 project out to the rear of a rear face of the upper-side movable guide 60 so as to abut the circumferential side face 31S of the drum 31.

In the upper-side movable guide 60, an upper end portion of the base 60B is rotatably supported at an upper end of a rear end portion of the upper-side conveyance guide 32, and the upper-side movable guide 60 is biased in a direction pressing against the circumferential side face 31S of the drum 31 by a spring 62 (see FIG. 5). Accordingly, the upper-side movable guide 60 is capable of moving so as to follow changes in the drum diameter of the drum 31, such that the following rollers 61 abut the circumferential side face 31S of the drum 31 at all times.

Moreover, as illustrated in FIG. 5, in the upper-side movable guide 60, a left-right direction spacing between the two legs 60L, 60R is slightly larger than the width of the main tape 42, such that the main tape 42 travels between the two legs 60L, 60R. Namely, the upper-side movable guide 60 has a shape that avoids the travel path of the main tape 42 pulled out from the drum 31 toward the second tape roller 46 of the upper-side conveyance guide 32 before doubling back toward the drum 31, such that the upper-side movable guide 60 is capable of moving without obstructing travel of the main tape 42. Note that in the upper-side movable guide 60, the following rollers 61 provided to the two legs 60L, 60R are disposed at positions opposing the locations where the auxiliary tapes 52 are wrapped onto the circumferential side face 31S of the drum 31 (this is referred to as a "wrap line"). Each following roller 61 abuts the corresponding auxiliary tape 52 wrapped onto the drum 31.

Moreover, lower faces of the two legs 60L, 60R of the upper-side movable guide 60 configure guide faces that extend the lower face of the upper-side conveyance guide 32. The guide faces are, for example, curved so as to follow a circle centered on the rotation axis of the upper-side movable guide 60. Moreover, lower end portions of the two legs 60L, 60R and lower end portions of the upper-side conveyance guide 32 are configured with nested shapes by plural comb teeth 60Lt, 60Rt, 32*t*, such that the guide faces of the upper-side movable guide 60 and the guide face of the upper-side conveyance guide 32 are connected at all times, even though the upper-side movable guide 60 is capable of moving.

Figure 7:
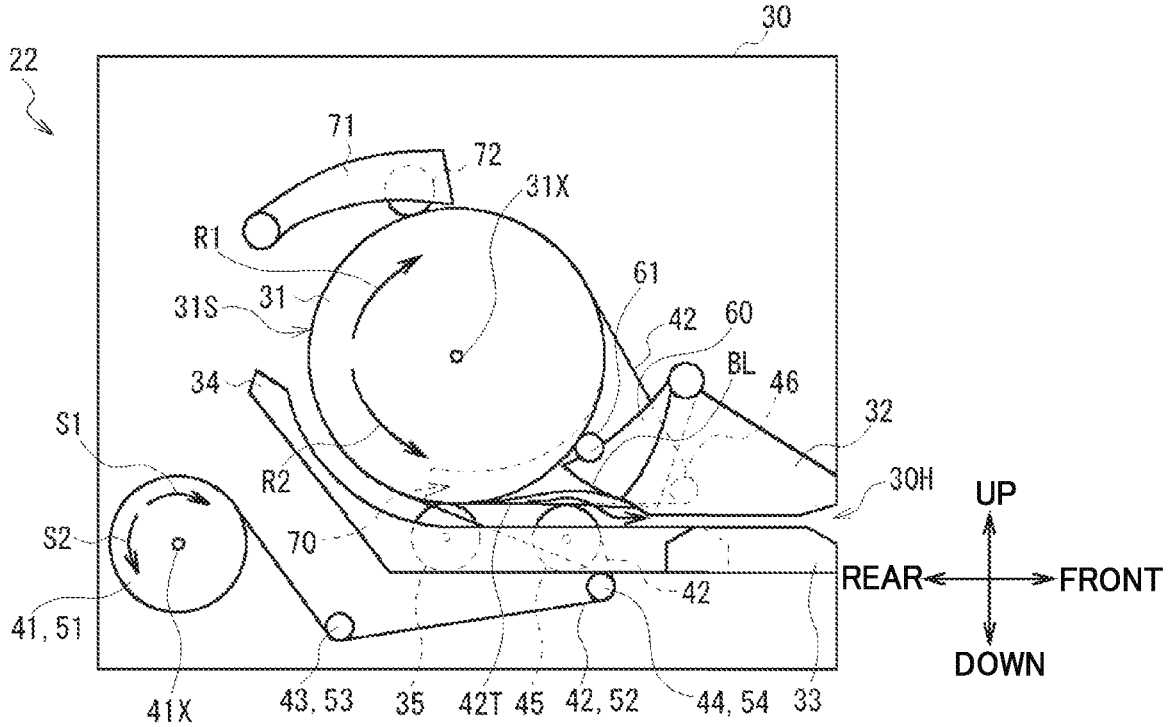
FIG. 7 is a diagram illustrating guidance of a banknote by an upper-side movable guide of the first exemplary embodiment.

The temporary holding section 22 includes the upper-side movable guide 60 configured in this manner. Accordingly, as illustrated in FIG. 7, for example, the temporary holding section 22 grips the center of a banknote BL with the banknote conveying portion 42T of the main tape 42 immediately after the banknote BL has been peeled away from the drum 31, and conveys the banknote BL toward the gap between the upper-side conveyance guide 32 and the lower-side conveyance guide 33. When this is performed, even if creases that would cause the two ends of the banknote BL to lift away are present, folding of the banknote BL is suppressed by the upper-side movable guide 60 positioned above the banknote BL gripped by the banknote conveying portion 42T, enabling the banknote BL to be guided from the circumferential side face 31S of the drum 31 toward the gap between the upper-side conveyance guide 32 and the lower-side conveyance guide 33 without catching on a rear face of the upper-side conveyance guide 32 or the like.

The temporary holding section 22 is configured such that when the main tape 42 that has been taken up onto the drum 31 is being peeled away from the drum 31, banknotes BL that have been taken up onto the drum 31 are also peeled away from the drum 31 together with the main tape 42. There is accordingly no need for a separate component such as a scraper in order to peel banknotes BL away from the drum 31. Accordingly, although the upper-side movable guide 60 does resemble a scraper in shape, the upper-side movable guide 60 does not have a function of peeling banknotes BL away from the drum 31, and simply functions as a guide.

Moreover, as illustrated in FIG. 3, the circumferential side face 31S of the drum 31 of the temporary holding section 22 is formed with a stopper groove 70 extending in the circumferential direction of the circumferential side face 31S. The stopper groove 70 is formed along the wrap line of the left side (or right side) auxiliary tape 52. Specifically, the stopper groove 70 is provided ahead of a fixing position P1 of the leading end of the auxiliary tape 52, and is configured by a groove extending approximately one quarter of the way around the circumferential side face 31S in the take-up direction (counterclockwise direction in the drawings) R1 of the drum 31 from the vicinity of the fixing position P1.

The width (length in a direction parallel to the axial direction of the drum 31) of the stopper groove 70 is narrower than the width of the auxiliary tape 52. Accordingly, the stopper groove 70 is covered by the auxiliary tape 52 when the auxiliary tapes 52 has been wrapped around at least once around the circumference of the drum 31, and when a wrap-on amount of the auxiliary tapes 52 is less than this, the stopper groove 70 is exposed.

The stopper groove 70 has a profile that becomes gradually deeper on progression from one end side, in the vicinity of the fixing position P1 of the auxiliary tape 52, toward the other end side. A wall face on the other end side, where the stopper groove 70 is deepest, is substantially orthogonal to the circumferential side face 31S of the drum 31.

Moreover, above the drum 31, the temporary holding section 22 is provided with a movable stopper 71 that is inserted into the stopper groove 70. The movable stopper 71 is configured in a plate shape extending in the front-rear direction, and has a width (left-right direction length) that is narrower than the width of the stopper groove 70. The movable stopper 71 is disposed above the wrap line of the left side auxiliary tape 52, and a lower face of the movable stopper 71 is curved so as to follow the circumferential side face 31S of the drum 31. Moreover, a following roller 72 is rotatably supported in the vicinity of a front end of the movable stopper 71. A lower side portion of the following roller 72 projects out below a lower face of the movable stopper 71 so as to abut a circumferential side face 31S of the drum 31.

A rear end portion of the movable stopper 71 is rotatably supported by the frame 30 of the temporary holding section 22, and, for example, is biased in a direction to press the following roller 72 against the circumferential side face 31S of the drum 31.

Figure 9A:
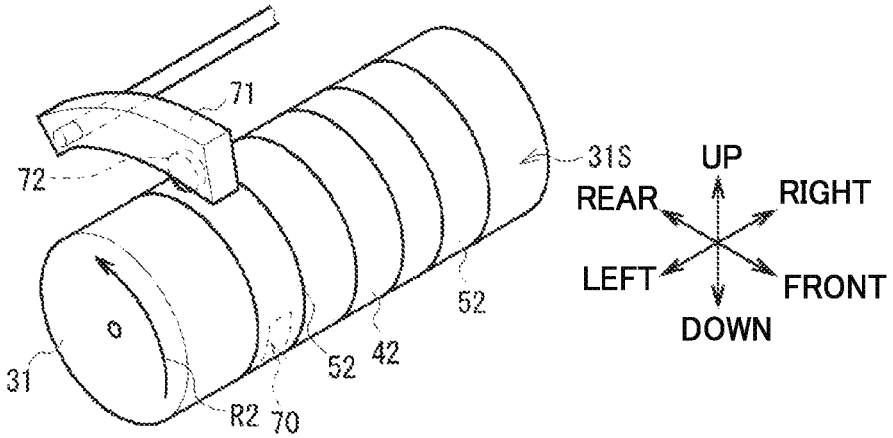
FIG. 9A is a perspective view illustrating insertion of a movable stopper into a stopper groove of a temporary holding section of the first exemplary embodiment.

As is also illustrated in FIG. 9A, in cases in which the wrap-on amount of the auxiliary tape 52 is at least one full circumference, the stopper groove 70 is covered by the auxiliary tape 52. Accordingly, since the following roller 72 of the movable stopper 71 abuts the auxiliary tape 52 at this time, the movable stopper 71 is not inserted into the stopper groove 70. Note that the movable stopper 71 is applied with a biasing force adjusted such that the auxiliary tape 52 is not pushed into the stopper groove 70.

Figure 8A:
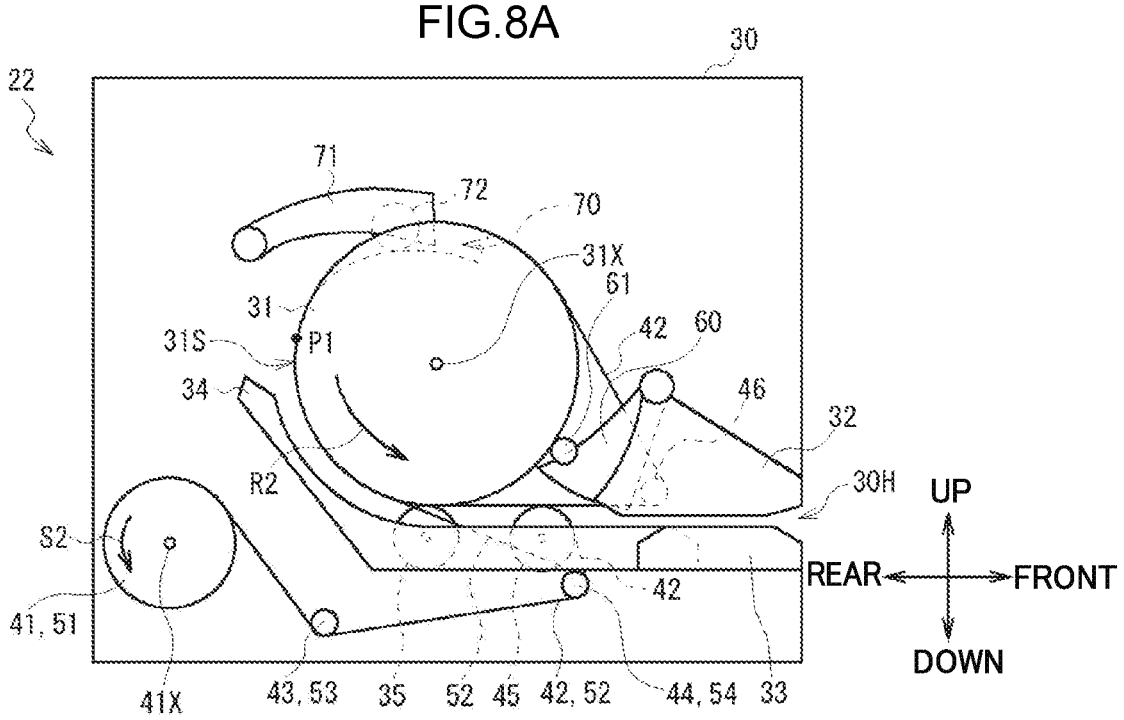
FIG. 8A is a side view illustrating insertion of a movable stopper into a stopper groove of a temporary holding section of the first exemplary embodiment.
Figure 8B:
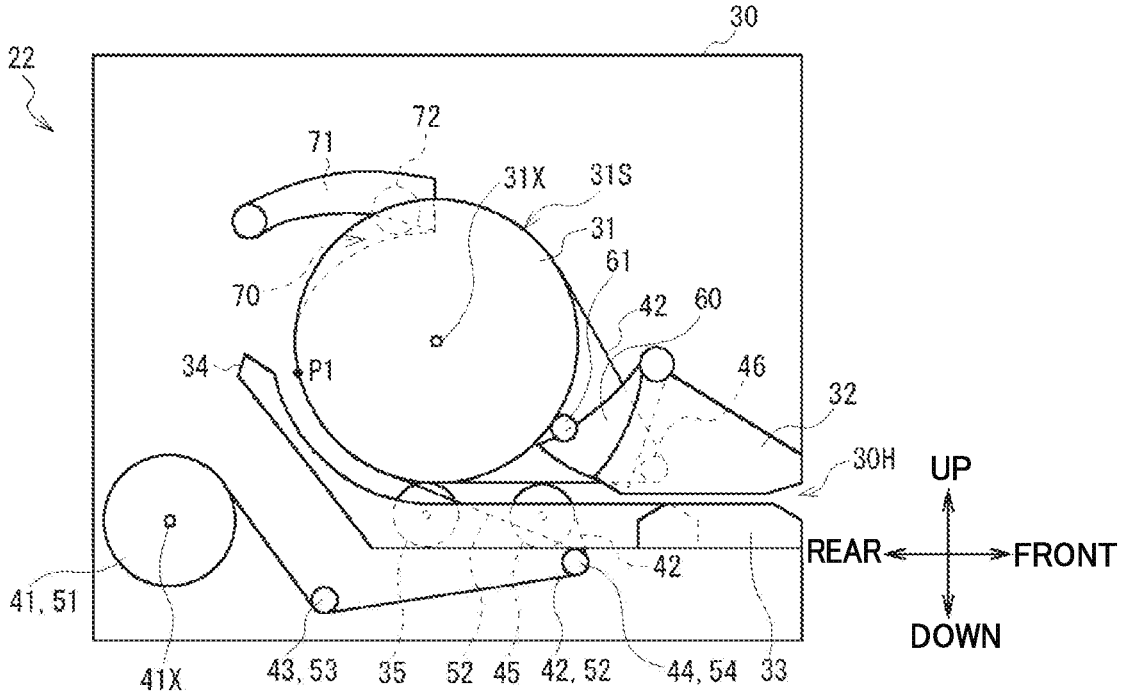
FIG. 8B is a side view illustrating insertion of a movable stopper into a stopper groove of a temporary holding section of the first exemplary embodiment.
Figure 9B:
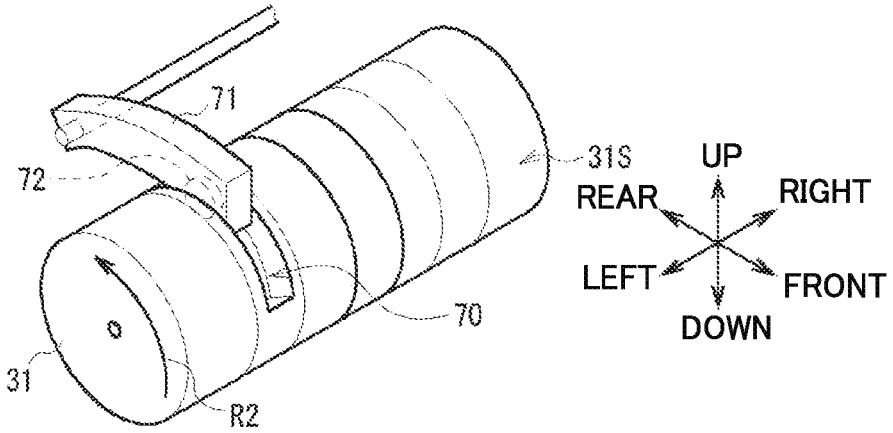
FIG. 9B is a perspective view illustrating insertion of a movable stopper into a stopper groove of a temporary holding section of the first exemplary embodiment.
Figure 9C:
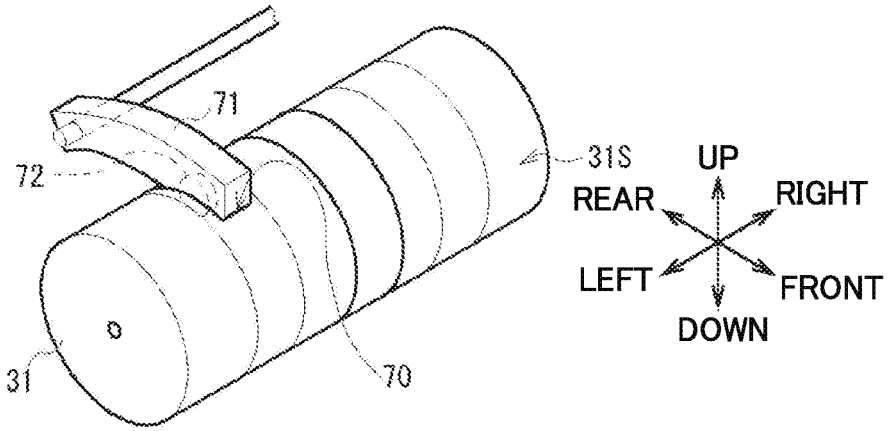
FIG. 9C is a perspective view illustrating insertion of a movable stopper into a stopper groove of a temporary holding section of the first exemplary embodiment.

On the other hand, for example, when the drum 31 is rotated in the unwind direction R2 so as to pull out the auxiliary tape 52, the stopper groove 70 is exposed when the wrap-on amount of the auxiliary tape 52 onto the drum 31 becomes less than one full circumference. Then, when the drum 31 rotates further in the unwind direction R2, as illustrated in FIG. 8A and FIG. 9B, the movable stopper 71 enters the stopper groove 70 from a leading end side, together with the following roller 72. When this occurs, the following roller 72 of the movable stopper 71 contacts the bottom of the stopper groove 70. Then, as illustrated in FIG. 8B and FIG. 9C, when the leading end of the movable stopper 71 abuts the wall face on the other end side (deepest point) of the stopper groove 70, the drum 31 cannot be rotated any further in the unwind direction R2.

In this manner, the temporary holding section 22 is provided with the stopper groove 70 and the movable stopper 71 that function as a stopper mechanism to render the drum 31 incapable of rotating beyond a predetermined position when the drum 31 is rotated in the unwind direction R2 direction.

Figure 10A:
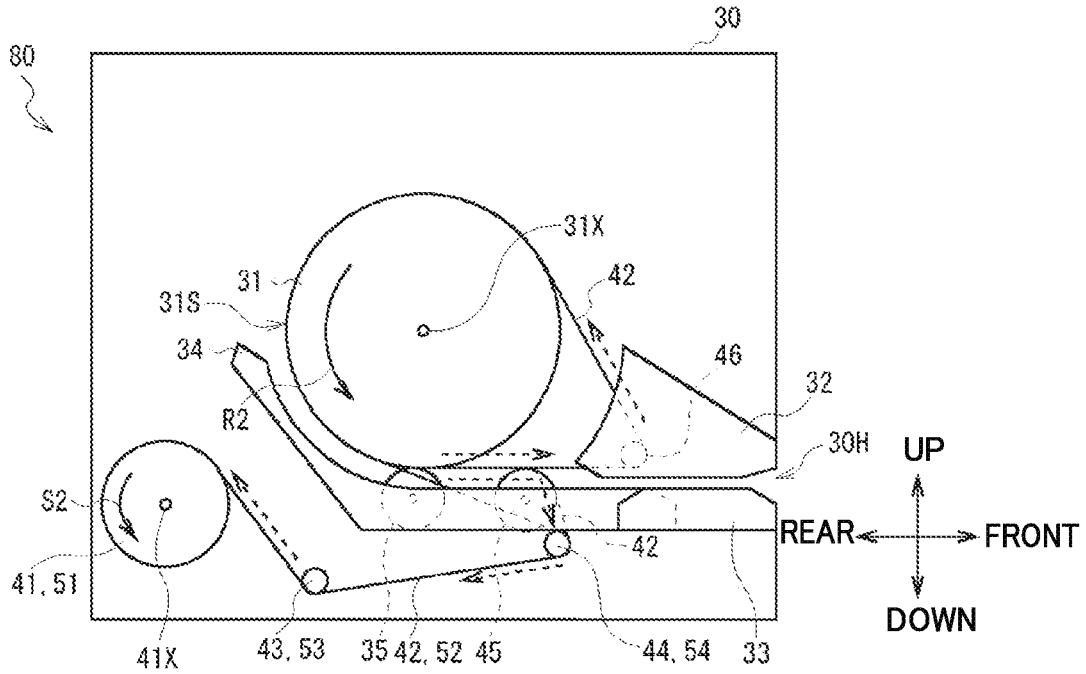
FIG. 10A is a side view illustrating movement of a main tape in a temporary holding section not including a stopper groove and a movable stopper.
Figure 10B:
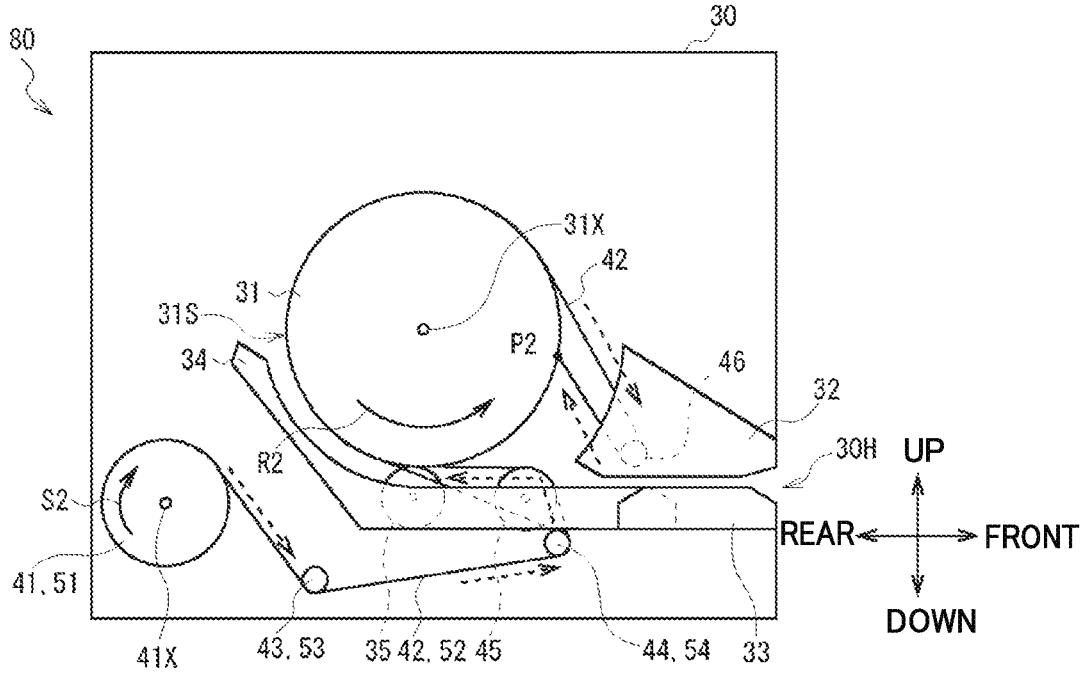
FIG. 10B is a side view illustrating movement of a main tape in a temporary holding section not including a stopper groove and a movable stopper.
Figure 11:
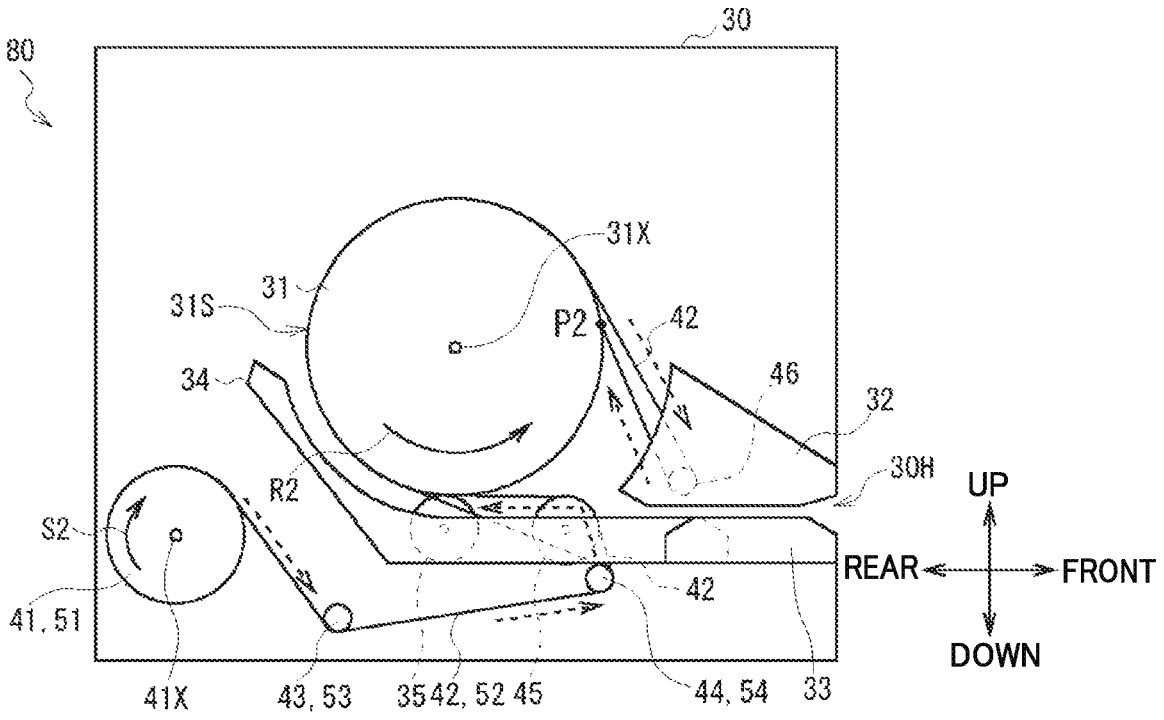
FIG. 11 is a side view illustrating movement of a main tape in a temporary holding section not including a stopper groove and a movable stopper.

Note that by way of a comparison with the temporary holding section 22, explanation follows regarding the movement of the main tape 42 in a configuration in which the drum 31 continues to be rotated in the unwind direction R2 in a temporary holding section 80 from which the stopper mechanism is omitted, with reference to FIG. 10 and FIG. 11. Note that as an example, the drum 31 is manually rotated in the unwind direction R2 using a knob or the like, not illustrated in the drawings.

As illustrated in FIG. 10A, when the drum 31 is rotated in the unwind direction R2, the main tape 42 travels in the direction illustrated by the dotted arrows in the drawing and is taken up onto the main reel 41. When the drum 31 has been rotated to a point where the wrap-on amount of the main tape 42 on the drum 31 becomes less than one full circumference (namely where an overlapping portion of the main tape 42 no longer remains on the drum 31), and the drum 31 continues to be rotated in the unwind direction R2, as illustrated in FIG. 10B, as a fixing position P2 of the leading end of the main tape 42 to the drum 31 proceeds in the unwind direction R2 from the vicinity of the lower end of the drum 31, the direction of travel of the main tape 42 switches from a direction to take up the main tape 42 onto the main reel 41 to a direction to pull the main tape 42 out from the main reel 41.

When the drum 31 then continues to be rotated even further in the unwind direction R2, as illustrated in FIG. 11, the main tape 42 is pulled out from the main reel 41 and is taken up onto the drum 31 in the opposite direction to previously. When the main tape 42 is taken up in the opposite direction, this is referred to as "reverse-winding".

Note that explanation of the movement of the auxiliary tapes 52 is omitted; however, the direction of travel of the auxiliary tapes 52 likewise switches to the opposite direction at approximately the same timing as the main tape 42, and the auxiliary tapes 52 are taken up in the opposite direction.

When the main tape 42 and the auxiliary tapes 52 have been reverse-wound, the main tape 42 and the auxiliary tapes 52 may become tangled when attempting to revert to the original take-up direction, which could result in the loss of the ability to take up banknotes BL onto the drum 31 correctly.

However, in the present exemplary embodiment, as described above, the temporary holding section 22 is provided with the stopper groove 70 and the movable stopper 71 serving as a stopper mechanism. Note that the position at which the stopper groove 70 and the movable stopper 71 abut is selected such that rotation of the drum 31 is stopped immediately before the main tape 42 and the auxiliary tape 52 would be reverse-wound on the drum 31.

Accordingly, in the temporary holding section 22, when the drum 31 is rotated in the unwind direction R2, the drum 31 can be stopped so as not to rotate any further immediately before the main tape 42 and the auxiliary tapes 52 would be reverse-wound (namely, at a timing when the main tape 42 and the auxiliary tapes 52 have been almost completely pulled out from the drum 31). This thereby enables reverse-winding of the main tape 42 and the auxiliary tapes 52 to be prevented.

1-3. Summary and Advantageous Effects

As described above, in the first exemplary embodiment, the upper-side conveyance guide 32 of the temporary holding section 22 is provided with the upper-side movable guide 60 that is capable of moving in coordination with the drum diameter of the drum 31 so as to be interposed between the upper-side conveyance guide 32 and the drum 31 at all times, and that guides banknotes BL between the upper-side conveyance guide 32 and the drum 31 when the banknotes BL are only being gripped and conveyed at the center by the banknote conveying portion 42T of the main tape 42.

Accordingly, even if creases that would cause the two ends of the banknote BL to lift away are present in a banknote BL, the temporary holding section 22 is capable of suppressing folding of the banknote BL using the upper-side movable guide 60 positioned above the banknote conveying portion 42T of the main tape 42, and is capable of guiding the banknote BL that has been peeled away from the drum 31 toward the gap between the upper-side conveyance guide 32 and the lower-side conveyance guide 33 without the banknote BL catching on the rear face of the upper-side conveyance guide 32 or the like. Accordingly, the temporary holding section 22 is capable of preventing conveyance issues caused by a banknote BL coming into contact with portions that should not be contacted.

Moreover, in the first exemplary embodiment, the temporary holding section 22 is provided with the stopper groove 70 and the movable stopper 71 serving as a stopper mechanism to stop the drum 31 such that the drum 31 does not rotate any further at a timing when the main tape 42 and the auxiliary tapes 52 have been almost completely pulled out from the drum 31 during rotation of the drum 31 in the unwind direction R2.

Accordingly, the temporary holding section 22 is capable of stopping the drum 31 such that the drum 31 does not rotate any further immediately before the main tape 42 and the auxiliary tapes 52 would be reverse-wound when the drum 31 is being rotated in the unwind direction R2. Accordingly, the temporary holding section 22 is capable of preventing reverse-winding of the main tape 42 and the auxiliary tapes 52.

Moreover, in the first exemplary embodiment, from the vicinity of the fixing position P1 of the leading end of the auxiliary tape 52, the stopper groove 70 formed on the circumferential side face 31S of the drum 31 has a profile becoming gradually deeper on progression around the circumferential side face 31S of the drum 31. Accordingly, the movable stopper 71 can be smoothly inserted into the stopper groove 70 simply by rotating the drum 31 in the unwind direction R2, and when inserted into the stopper groove 70, the movable stopper 71 can be made to leave the stopper groove 70 smoothly simply by rotating the drum 31 in the take-up direction R1.

2. Second Exemplary Embodiment

Next, explanation follows regarding a second exemplary embodiment. The second exemplary embodiment is an exemplary embodiment in which the configuration of the temporary holding section differs from that in the first exemplary embodiment. Since configuration other than that of the temporary holding section is similar to that of the first exemplary embodiment, the first exemplary embodiment should be referred to for more detailed explanation. Accordingly, the forthcoming explanation focuses mainly on the configuration of the temporary holding section.

2-1. Temporary Holding Section Configuration

FIG. 12 illustrate a temporary holding section 100 of the second exemplary embodiment. Note that the temporary holding section 100 illustrated in FIG. 12 is appended with the same reference numerals as equivalent portions in the temporary holding section 22 of the first exemplary embodiment.

Figure 12A:
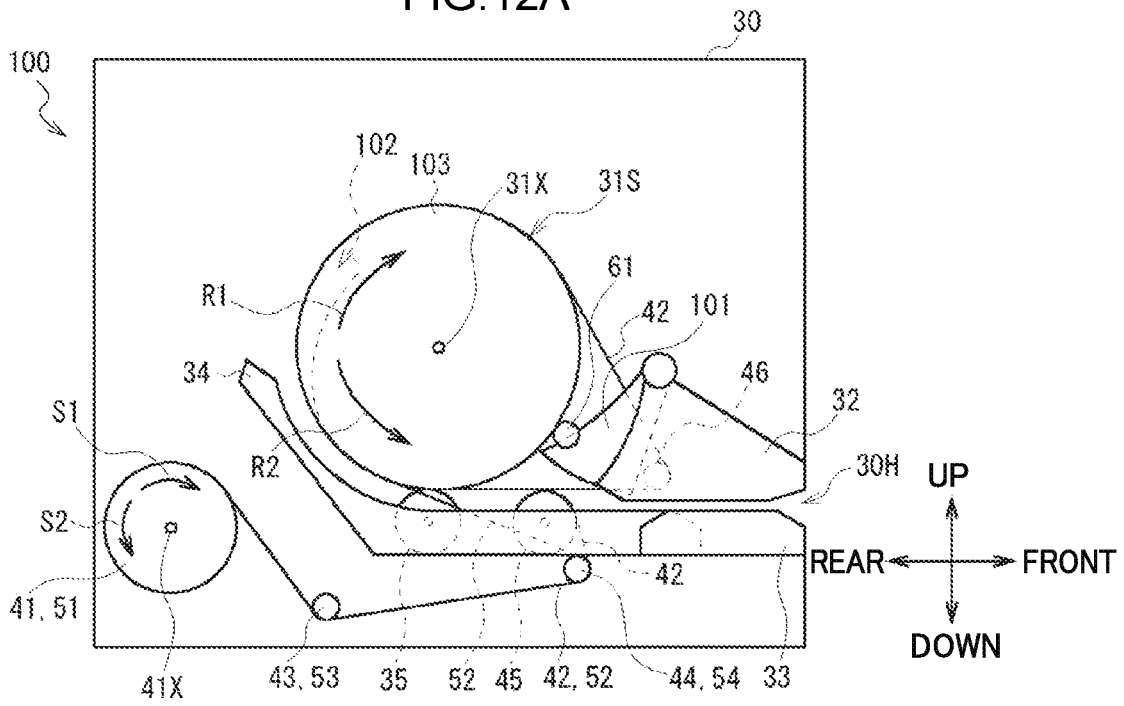
FIG. 12A is a side view illustrating an internal configuration of a temporary holding section of a second exemplary embodiment.

As illustrated in FIG. 12A, the movable stopper 71 of the temporary holding section 22 is omitted in the temporary holding section 100, and an upper-side movable guide-cum-stopper 101 that combines the functions of both the upper-side movable guide 60 and the movable stopper 71 is provided instead of the upper-side movable guide 60. Note that the upper-side movable guide-cum-stopper 101 has the same basic configuration as the upper-side movable guide 60, and so the first exemplary embodiment should be referred to for more detailed explanation.

Moreover, instead of the drum 31, the temporary holding section 100 includes a drum 103 formed with stopper grooves 102 into which the upper-side movable guide-cum-stopper 101 is inserted.

The stopper grooves 102 are configured by grooves into which a lower end portion of one leg 60L (or one leg 60R), and a following roller 61, of the upper-side movable guide-cum-stopper 101 are inserted. Note that since the left-right direction width of the leg 60L is approximately the same as the width of the auxiliary tape 52, were a single stopper 102 to be configured with width large enough to allow insertion of the leg 60L and the following roller 61, the auxiliary tape 52 would also enter the stopper groove 102.

Accordingly, in the drum 103, for example, plural stopper grooves 102 of narrower width than the auxiliary tape 52 are formed at predetermined spacings from each other in the axial direction, and plural comb teeth 60Lt (see FIG. 5) formed at the lower end portion of the leg 60L are respectively inserted into the stopper grooves 102. Note that since the following roller 61 is also inserted into one out of the plural stopper grooves 102 (namely the outermost stopper groove 102), this stopper groove 102 is configured with a wider width than the other stopper grooves 102. Moreover, at least one out of the plural stopper grooves 102 (for example, the outermost stopper groove 102) is formed on the wrap line of the left side auxiliary tape 52. Namely, at least one out of the stopper grooves 102 is covered by the auxiliary tape 52.

Figure 12B:
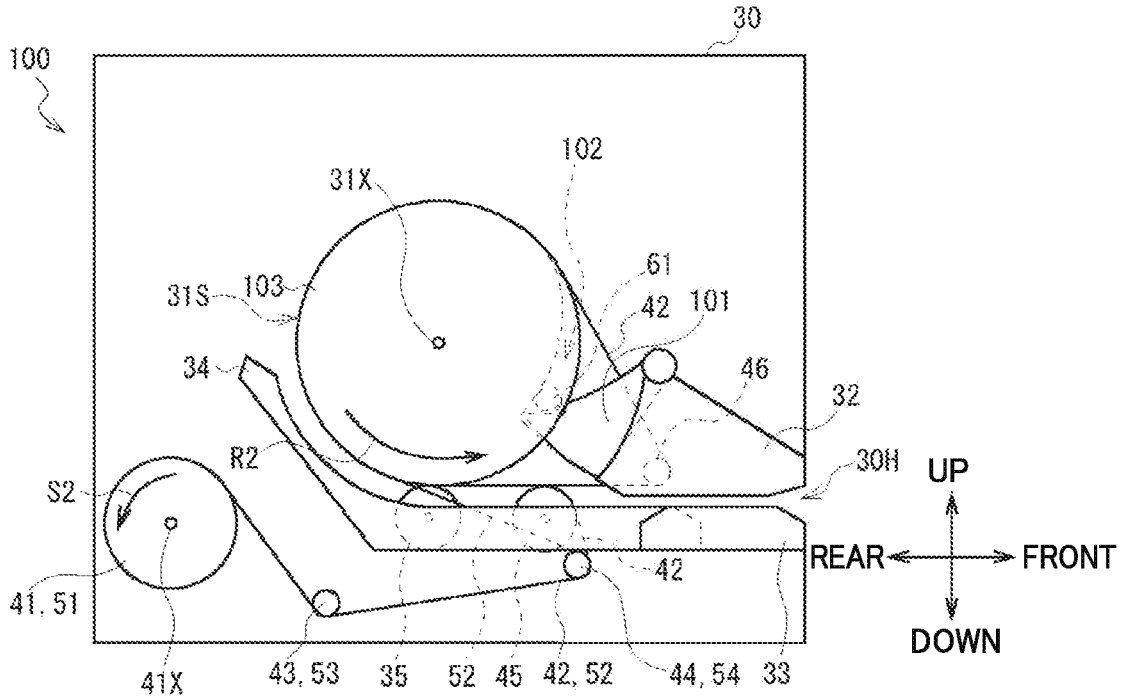
FIG. 12B is a side view illustrating an internal configuration of a temporary holding section of the second exemplary embodiment.

Accordingly, in the temporary holding section 100, when the drum 103 rotates in the unwind direction R2 to a point where the auxiliary tapes 52 have been pulled out far enough that the wrap-on amount of the auxiliary tapes 52 on the drum 103 becomes less than one full circumference, the stopper groove 102 formed on the wrap line of the auxiliary tape 52 is exposed, thereby exposing all of the stopper grooves 102. Then, when the drum 103 is rotated further in the unwind direction R2, the upper-side movable guide-cum-stopper 101 enters the stopper grooves 102 together with the following roller 61 from the rear end (rear end of the comb teeth 60Lt) side of a lower end portion of the upper-side movable guide-cum-stopper 101. As illustrated in FIG. 12B, the rear end of the lower end portion (rear ends of the comb teeth 60Lt) of the upper-side movable guide-cum-stopper 101 abuts the wall face on the other end side (deepest point) of the stopper groove 102, such that the drum 31 becomes unable to rotate any further in the unwind direction R2.

In this manner, the upper-side movable guide-cum-stopper 101 functions not only as a guide but also as a stopper. Note that the position where the stopper groove 102 and the upper-side movable guide-cum-stopper 101 abut each other is set so as to stop rotation of the drum 103 immediately before the main tape 42 and the auxiliary tapes 52 would be reverse-wound onto the drum 103.

2-2. Summary and Advantageous Effects

As described above, in the second exemplary embodiment, the upper-side conveyance guide 32 of the temporary holding section 100 is provided with the upper-side movable guide-cum-stopper 101 that is capable of moving in coordination with the drum diameter of the drum 103 so as to be interposed between the upper-side conveyance guide 32 and the drum 103 at all times, and that includes a guide function, when rotating the drum 103 in the unwind direction R2, to guide banknotes BL gripped and conveyed only at the center by the banknote conveying portion 42T of the main tape 42, and a stopper function to stop the drum 103 such that the drum 103 becomes unable to rotate any further at a timing when the main tape 42 and the auxiliary tapes 52 have been almost completely pulled out from the drum 103.

Accordingly, in the temporary holding section 100, folding of the banknotes BL is suppressed by the upper-side movable guide-cum-stopper 101, enabling conveyance issues caused by a banknote BL coming into contact with portions that should not be contacted to be prevented, and enabling reverse-winding of the main tape 42 and the auxiliary tapes 52 to be prevented.

Moreover, in the temporary holding section 100, the upper-side movable guide-cum-stopper 101 combines both the guide function and the stopper function, thereby enabling a simpler configuration than in the first exemplary embodiment, and thus enabling a reduction in manufacturing costs, a reduction in maintenance costs, and so on.

3. Other Exemplary Embodiments

3-1. Other Exemplary Embodiment 1

Note that in the first exemplary embodiment described above, the stopper groove 70 is formed on one axial direction end side of the circumferential side face 31S of the drum 31 (on the wrap line of one out of the two auxiliary tapes 52). There is no limitation thereto, and one more stopper groove 70 may be formed on the other axial direction end side of the circumferential side face 31S of the drum 31 (on the other wrap line). Namely, respective stopper grooves 70 may be formed on both axial direction end sides of the circumferential side face 31S of the drum 31. In such cases, one extra movable stopper 71 may be provided such that the movable stoppers 71 are inserted into the two stopper grooves 70. So doing enables rotation of the drum 31 to be stopped more firmly than when rotation of the drum 31 is stopped using a single movable stopper 71.

Moreover, in the second exemplary embodiment, respective stopper grooves 102 may similarly be formed on both axial direction end sides of a circumferential side face 103S of the drum 103. In such cases, the two legs 60L, 60R of the upper-side movable guide-cum-stopper 101 may be inserted into the respective stopper grooves 102 on the one end side and on the other end side.

3-2. Other Exemplary Embodiment 2

In the second exemplary embodiment described above, the drum 103 is formed with plural of the stopper grooves 102 into which the plural comb teeth 60Lt and the following roller 61 formed at the lower end portion of the leg 60L of the upper-side movable guide-cum-stopper 101 are inserted, the stopper grooves 102 each having a width narrower than that of the auxiliary tape 52.

In this configuration, due to providing the following roller 61 at the outer face of the leg 60L, the outermost comb tooth 60Lt of the leg 60L and the following roller 61 are inserted into the outermost (left side) stopper groove 102 of the plural stopper grooves 102.

There is no limitation thereto, and the following roller 61 may be provided at other positions in the left-right direction of the leg 60L. For example, the following roller 61 may be provided at the center of the leg 60L, and out of the plural stopper grooves 102, the central comb tooth 60Lt of the leg 60L and the following roller 61 may be inserted into the central stopper groove 102. In such cases, the size of the upper-side movable guide-cum-stopper 101 may be adjusted such that the following roller 61 is positioned facing the wrap line of the auxiliary tape 52, such that the following roller 61 abuts the auxiliary tape 52 when the central stopper groove 102 is covered by the auxiliary tape 52.

3-3. Other Exemplary Embodiment 3

Moreover, in the first exemplary embodiment described above, the temporary holding section 22 is provided with the upper-side movable guide 60 that guides banknotes BL conveyed gripped only at the center by the banknote conveying portion 42T of the main tape 42, and the stopper groove 70 and the movable stopper 71 that are provided in order to stop the drum 31 such that the drum 31 does not rotate any further at a timing when the main tape 42 and the auxiliary tapes 52 have been almost completely pulled out from the drum 31.

Figure 13:
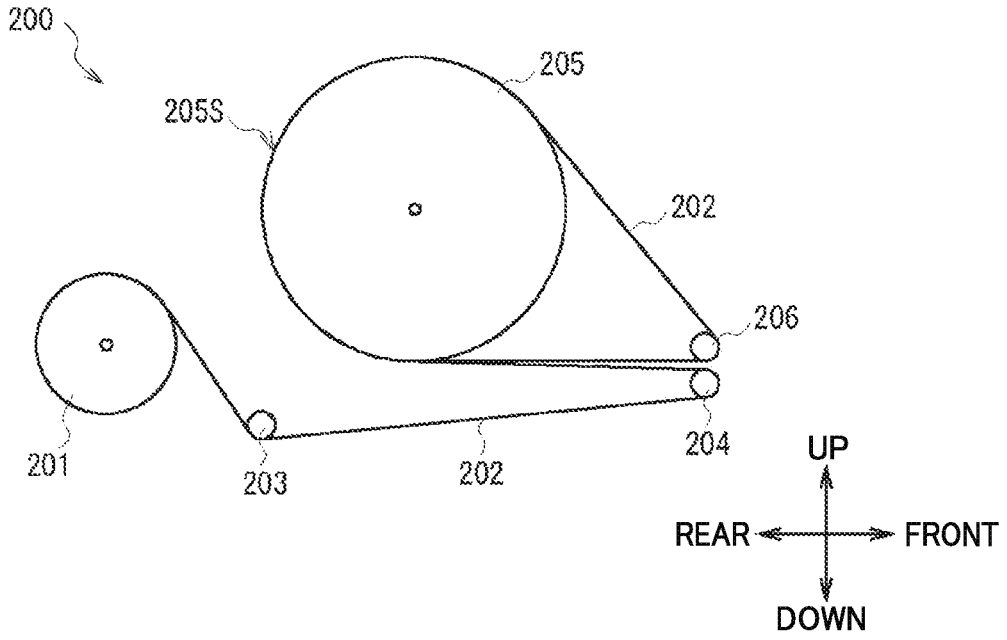
FIG. 13 is a side view illustrating an internal configuration of a conventional temporary holding section.
Figure 14:
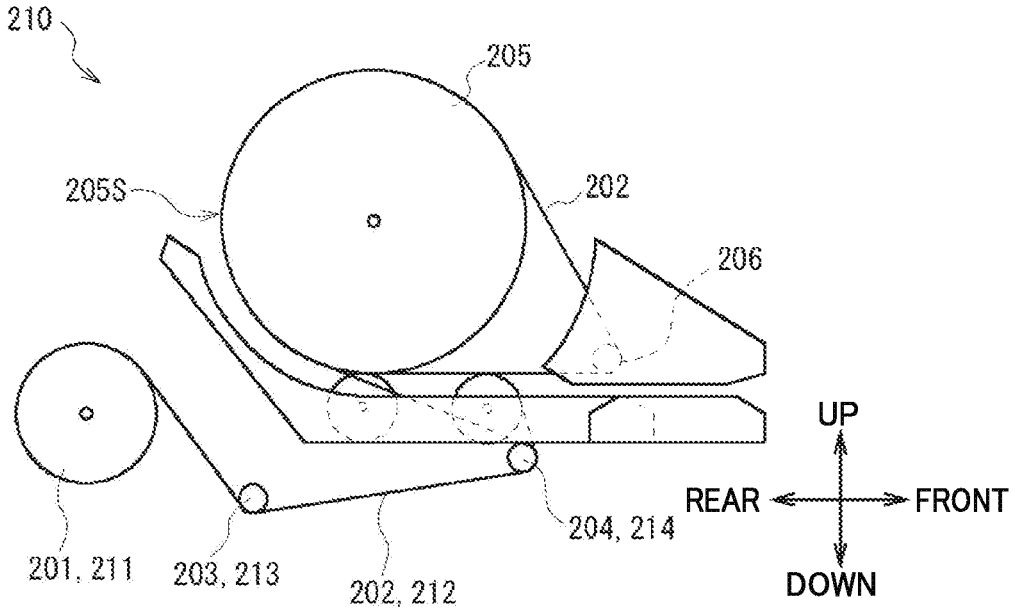
FIG. 14 is a side view illustrating an internal configuration of a conventional temporary holding section.
Figure 15:
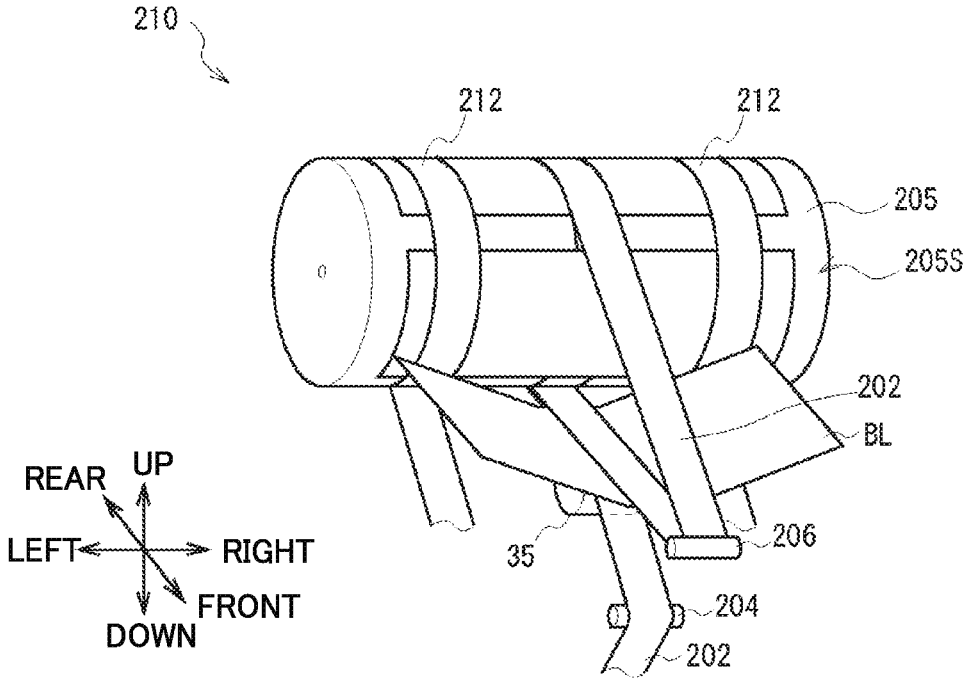
FIG. 15 is a perspective view illustrating folding of a banknote in a conventional temporary holding section.
Figure 16:
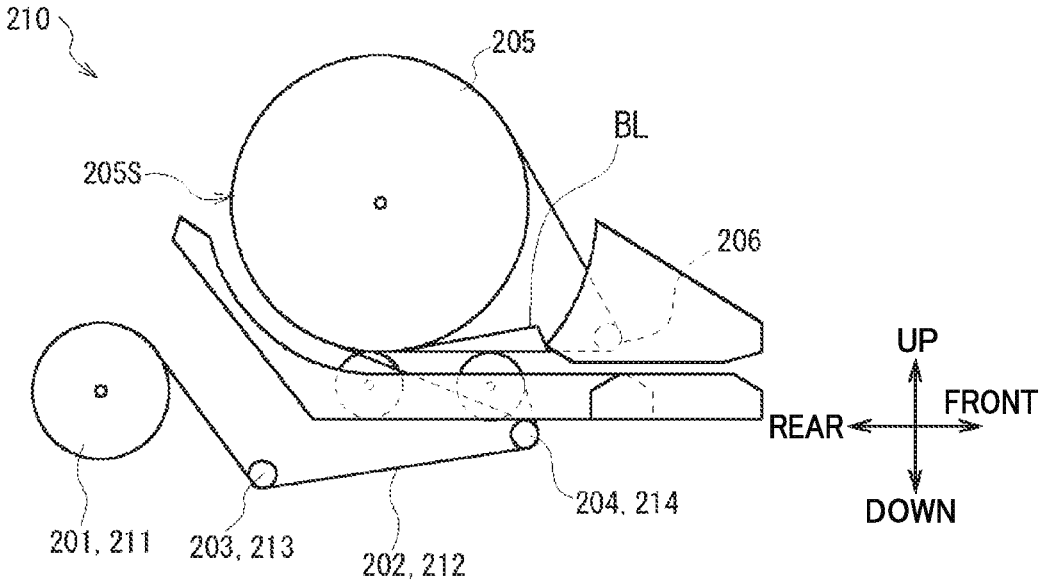
FIG. 16 is a perspective view illustrating folding of a banknote in a conventional temporary holding section.

There is no limitation thereto, and the temporary holding section 22 may be provided with either out of the upper-side movable guide 60, or the stopper groove 70 and the movable stopper 71. Moreover, in cases in which only the upper-side movable guide 60 is provided, there is no limitation to the temporary holding section 22 being of a type that presses the length direction center and both ends of the banknotes BL against the drum 31 using a total of three tapes configured by the single main tape 42 and the two auxiliary tapes 52. For example, application may also be made to a temporary holding section of a type that presses the centers of banknotes BL against the drum using only a single tape, as illustrated in FIG. 13.

3-4. Other Exemplary Embodiment 4

Moreover, in each of the exemplary embodiments described above, the present invention is applied to the temporary holding section 22, 100 serving as a medium processing device. However, the present invention is not limited thereto, and the present invention may also be applied to a medium processing device configured differently to the temporary holding section 22, 100 as long as it uses a tape to grip the center of a medium in a direction orthogonal to a conveyance direction and wrap the medium onto a drum to be stored.

Moreover, in each of the exemplary embodiments described above, the present invention is applied to the ATM 1 serving as a medium transaction device that handles banknotes. However, there is no limitation thereto, and application may also be made to a medium transaction device configured differently to the ATM 1, that is, a medium transaction device that handles a medium other than banknotes, for example paper or tickets, as long as the medium transaction device includes a medium processing section that wraps the medium onto a drum together with a tape to be stored.

Moreover, in each of the exemplary embodiments described above, the upper-side conveyance guide 32 is employed as a specific example of a medium conveyance guide. However, there is no limitation thereto, and a medium conveyance guide configured differently to the upper-side conveyance guide 32 may be employed as long as it is fixed at a position separated from a circumferential side face of a drum and supports a second tape roller.

Moreover, in each of the exemplary embodiments described above, the upper-side movable guide 60 or the upper-side movable guide-cum-stopper 101 are employed as specific examples of movable guides. However, there is no limitation thereto, and a movable guide configured differently to the upper-side movable guide 60 and the upper-side movable guide-cum-stopper 101 may be employed as long as it is capable of guiding, between a circumferential side face of a drum and a medium conveyance guide (upper-side conveyance guide 32), a medium that is conveyed gripped by a main tape at a portion of the main tape that doubles back around a first tape roller and a portion of the main tape that doubles back around a second tape roller.

Moreover, in the first exemplary embodiment described above, the stopper groove 70 has a shape becoming gradually deeper from the one end side toward the other end side, and the movable stopper 71 enters the stopper groove 70 from the one end side accompanying rotation of the drum 31 in the unwind direction R2. However, there is no limitation thereto, and a stopper mechanism configured differently to the stopper groove 70 and the movable stopper 71 may be employed, as long as it is capable of stopping any further rotation of the drum 31 at a timing when the main tape 42 and the auxiliary tapes 52 have been almost completely pulled out from the drum 31. Similar also applies in the second exemplary embodiment.

Moreover, in each of the exemplary embodiments described above, the banknote pay-in/pay-out section 20 is employed as a specific example of a take-in section in which a paper sheet shaped medium to be transacted is taken in from outside. However, there is no limitation thereto, and, for example, if transacting a medium other than banknotes, a take-in section adapted for that medium may be employed.

3-5. Other Exemplary Embodiment 5

Moreover, the present invention is not limited to the respective exemplary embodiments described above. Namely, the range of application of the present invention also encompasses exemplary embodiments of freely selected combinations of some or all of the first exemplary embodiment and the second exemplary embodiment and the other exemplary embodiments described above, and embodiments deriving from elements thereof.

The disclosure of Japanese Patent Application No. 2015-102109 is incorporated in its entirety by reference herein.

All cited documents, patent applications, and technical standards mentioned in the present specification are incorporated by reference in the present specification to the same extent as if the individual cited document, patent application, or technical standard was specifically and individually indicated to be incorporated by reference.

INDUSTRIAL APPLICABILITY

The present invention may be employed in various devices that temporarily hold a paper sheet shaped medium wrapped onto a drum.

The invention claimed is:

1. A medium processing device comprising:

a drum that is rotatably supported, and that wraps a paper sheet shaped medium onto a circumferential side face of the drum;

a continuous main tape of which one end is fixed to the circumferential side face of the drum, and that wraps the medium onto the circumferential side face of the drum accompanying rotation of the drum such that the medium is interposed between the circumferential side face and the main tape;

a main reel that takes up the main tape;

a feed roller that is provided at a position separated from the circumferential side face and that feeds the main tape to convey the medium;

a first tape roller that is provided at a position separated from the circumferential side face of the drum and around which the main tape pulled out from the main reel doubles back toward the circumferential side face of the drum;

a second tape roller that is provided at a position separated from the circumferential side face of the drum, and that temporarily pulls the main tape away from the circumferential side face and doubles back the main tape so as to return toward the circumferential side face, after the main tape has been doubled back around the first tape roller and travelled along the circumferential side face of the drum, the second tape roller doubling back the main tape such that a first portion of the main tape doubled back around the first tape roller and a second portion of the main tape doubled back around the second tape roller come together to overlap each other at a location between the circumferential side face of the drum and the feed roller along the second portion of the main tape;

a medium conveyance guide that is fixed at a position separated from the circumferential side face of the drum, that supports the second tape roller, and that guides conveyance of the medium; and a movable guide that is provided to the medium conveyance guide so as to be capable of moving to follow a drum diameter of the drum as the drum diameter changes according to a wrap-on amount of the medium, and that guides the medium being conveyed while being gripped between the first portion of the main tape doubled back around the first tape roller and the second portion of the main tape doubled back around the second tape roller such that the medium is guided between the circumferential side face of the drum and the medium conveyance guide.

2. The medium processing device of claim 1, further comprising:

an auxiliary tape of which one end is fixed to the circumferential side face of the drum at a position separated in an axial direction of the drum from the position where the one end of the main tape is fixed, and that together with the main tape wraps the medium onto the circumferential side face of the drum accompanying rotation of the drum; and an auxiliary reel that takes up the auxiliary tape.

3. The medium processing device of claim 2, further comprising:

a stopper groove that is formed in the circumferential side face of the drum on a wrap line where the auxiliary tape is wrapped, that is covered by the auxiliary tape as the auxiliary tape is wrapped onto the drum, and that is exposed as the auxiliary tape is pulled out from the drum; and a movable stopper that is provided to the circumferential side face of the drum at a position opposing the wrap line of the auxiliary tape so as to be capable of moving to follow the drum diameter of the drum, the movable stopper being capable of engaging with the stopper groove, and wherein the movable stopper stops rotation of the drum by engaging with the stopper groove when the drum rotates in a direction to pull out the auxiliary tape and the drum has rotated far enough to expose the stopper groove that was covered by the auxiliary tape.

4. The medium processing device of claim 1, wherein the movable guide includes a following roller, and the following roller abuts the circumferential side face of the drum.

5. The medium processing device of claim 2, wherein a following roller of the movable guide is provided at a position opposing a wrap line where the auxiliary tape is wrapped onto the circumferential side face of the drum, and abuts the auxiliary tape wrapped around the drum.

6. The medium processing device of claim 3, wherein the movable stopper includes a following roller, and the following roller abuts the auxiliary tape while the stopper groove is covered by the auxiliary tape, and the following roller enters the stopper groove and abuts a bottom of the stopper groove when the stopper groove is exposed.

7. The medium processing device of claim 3, wherein the stopper groove is a groove extending around the circumferential side face of the drum from the vicinity of a position where one end of the auxiliary tape is fixed to the circumferential side face of the drum, and the stopper groove becomes gradually deeper from one end side of the stopper groove in the vicinity of the position where the one end of the auxiliary tape is fixed toward another end side of the stopper groove.

8. The medium processing device of claim 7, wherein the movable stopper enters the stopper groove from the one end side of the exposed stopper groove accompanying rotation of the drum in a direction to pull out the auxiliary tape, and stops rotation of the drum by abutting the other end side of the stopper groove.

9. The medium processing device of claim 3, wherein:

the movable guide also functions as the movable stopper; and a portion of the movable guide at a position opposing the wrap line of the auxiliary tape on the circumferential side face of the drum stops rotation of the drum by engaging with the exposed stopper groove when the drum has rotated far enough to expose the stopper groove.

10. The medium processing device of claim 1, wherein a coupling section where a guide face of the movable guide and a guide face of the medium conveyance guide are coupled together has a nested shape.

11. A medium transaction device comprising:

a take-in section that takes in a paper sheet shaped medium to be transacted from outside;

a conveyance section that conveys the medium;

a drum that is configured capable of rotating, and that wraps the medium conveyed in by the conveyance section onto a circumferential side face of the drum;

a continuous main tape of which one end is fixed to the circumferential side face of the drum, and that wraps the medium onto the circumferential side face accompanying rotation of the drum such that the medium is interposed between the circumferential side face and the main tape;

a main reel that takes up the main tape;

a feed roller that is provided at a position separated from the circumferential side face of the drum and that feeds the main tape to convey the medium;

a first tape roller that is provided at a position separated from the circumferential side face of the drum and around which the main tape pulled out from the main reel doubles back toward the circumferential side face of the drum;

a second tape roller that is provided at a position separated from the circumferential side face of the drum, and that temporarily pulls the main tape away from the circumferential side face and doubles back the main tape so as to return toward the circumferential side face, after the main tape has been doubled back around the first tape roller and travelled along the circumferential side face of the drum, the second tape roller doubling back the main tape such that a first portion of the main tape doubled back around the first tape roller and a second portion of the main tape doubled back around the second tape roller come together to overlap each other at a location between the circumferential side face of the drum and the feed roller along the second portion of the main tape;

a medium conveyance guide that is fixed at a position separated from the circumferential side face of the drum, that supports the second tape roller, and that guides conveyance of the medium; and a movable guide that is provided to the medium conveyance guide so as to be capable of moving to follow a drum diameter of the drum as the drum diameter changes according to a wrap-on amount of the medium, and that guides the medium being conveyed while being gripped between the first portion of the main tape doubled back around the first tape roller and the second portion of the main tape doubled back around the second tape roller such that the medium is guided between the circumferential side face of the drum and the medium conveyance guide.

* * * * *